US010503104B2

(12) United States Patent
Matsuura

(10) Patent No.: US 10,503,104 B2
(45) Date of Patent: Dec. 10, 2019

(54) FIXING APPARATUS AND IMAGE FORMING APPARATUS HAVING A PAD THAT PRESSES AN ENDLESS BELT

(71) Applicant: CANON KABUSHIKI KAISHA, Tokyo (JP)

(72) Inventor: Daigo Matsuura, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 72 days.

(21) Appl. No.: 16/015,530

(22) Filed: Jun. 22, 2018

(65) Prior Publication Data

US 2018/0299807 A1 Oct. 18, 2018

Related U.S. Application Data

(63) Continuation of application No. PCT/JP2016/089225, filed on Dec. 22, 2016.

(30) Foreign Application Priority Data

Dec. 25, 2015 (JP) ..... 2015-253571
Dec. 25, 2015 (JP) ..... 2015-253572
Dec. 9, 2016 (JP) ..... 2016-239248

(51) Int. Cl.
*G03G 15/20* (2006.01)
*G03G 15/00* (2006.01)

(52) U.S. Cl.
CPC ..... *G03G 15/2053* (2013.01); *G03G 15/6594* (2013.01); *G03G 2215/00514* (2013.01)

(58) Field of Classification Search
None
See application file for complete search history.

(56) References Cited

U.S. PATENT DOCUMENTS 7,113,716 B2 9/2006 Tomatsu
7,200,354 B2 4/2007 Nakamoto et al.
(Continued)

FOREIGN PATENT DOCUMENTS

JP 2004-279702 A 10/2004
JP 2008-233133 A 10/2008
(Continued)

OTHER PUBLICATIONS

International Search Report and Written Opinion dated Mar. 7, 2017, issued in corresponding International Patent Application No. PCT/JP2016/089225.

*Primary Examiner* — David M. Gray
*Assistant Examiner* — Geoffrey T Evans
(74) *Attorney, Agent, or Firm* — Venable LLP

(57) ABSTRACT

A fixing device for an envelope includes an endless belt, a driving rotatable member, and a pad that includes a base portion, a first projecting portion projecting from the base portion toward the driving rotatable member at an upstream end in a feeding direction of the envelope, a second projecting portion projecting from the base portion toward the driving rotatable member at a downstream end in the feeding direction of the envelope, and a recess portion, provided between the first projecting portion and the second projecting portion in the feeding direction of the envelope. When a fixing process is performed on the envelope, an inner surface of the endless belt is in contact with both of the first projecting portion and the second projecting portion, and is spaced from the recess portion.

9 Claims, 20 Drawing Sheets

(56) References Cited

U.S. PATENT DOCUMENTS

| | | | | |
|---|---|---|---|---|
| 7,596,348 | B2 | 9/2009 | Nakamoto et al. | |
| 8,761,621 | B2 | 6/2014 | Sakai | |
| 9,037,024 | B2 | 5/2015 | Kasama | |
| 2009/0041516 | A1* | 2/2009 | Fukaya | G03G 15/206 399/333 |
| 2009/0226227 | A1* | 9/2009 | Furukata | G03G 15/206 399/328 |
| 2018/0024479 | A1* | 1/2018 | Yamada | G03G 15/2042 399/67 |

FOREIGN PATENT DOCUMENTS

| | | | |
|---|---|---|---|
| JP | 2009-103982 | A | 5/2009 |
| JP | 2013-073207 | A | 4/2013 |
| JP | 2013-137580 | A | 7/2013 |
| JP | 2013-225039 | A | 10/2013 |
| JP | 2014-240989 | A | 12/2014 |
| JP | 2015-210456 | A | 11/2015 |
| WO | 2017/111180 | A1 | 6/2017 |

* cited by examiner

FIXING APPARATUS AND IMAGE FORMING APPARATUS HAVING A PAD THAT PRESSES AN ENDLESS BELT

CLAIM TO PRIORITY

This application is a continuation of International Patent Application No. PCT/JP2016/089225, filed Dec. 22, 2016, the contents of which are incorporated herein by reference.

TECHNICAL FIELD

The present invention relates to a fixing device for fixing a toner image on a recording material, and an image forming apparatus including the fixing device. This image forming apparatus may be a copying machine, a printer, a facsimile machine, a multifunction machine including a plurality of these functions, or the like, for example.

BACKGROUND ART

An electrophotographic copying machine, or the like, is provided with a fixing device for fixing a toner image transferred onto the recording material by heat and pressure.

As a fixing device, various types are known to raise a temperature at a high speed. Those fixing devices in which a fixing roller is made thinner and smaller in diameter, those fixing devices in which a heating member is pressed against a rotating member, formed of a resin film, from an inside thereof, those fixing devices in which a thin metal rotating member is heated by induction heating, and the like, are known. All of these fixing devices are designed to reduce a heat capacity of the rotatable member, which is a heating member, and to heat the rotatable member with a heat source with a high heating efficiency.

In Japanese Patent Document No. 2004-279702, in order to prevent the production of a crease in an envelope, the pressing force per unit area of a first pressing roller and a second pressing roller to the heating roller is changed between a normal pressure mode and an envelope pressure mode. In the envelope pressure mode, the pressing force per unit area to the heating roller of the first pressing roller and the pressing force per unit area to the heating roller of the second pressing roller are reduced to prevent production of an envelope crease.

In the apparatus described in Japanese Patent Document No. 2013-225039, in order to prevent production of an envelope crease, the shape of a fixing nip portion N is switched from a nip mode in which a flat portion and a curved portion are in contact, to a nip mode in which only the flat portion contacts.

In the structures described above, however, in order to improve the prevention of the envelope crease, it is necessary to lower the pressing force per unit area more than necessary, and there is room for improvement.

SUMMARY OF THE INVENTION

According to one aspect, the present inventions provides a fixing device for an envelope, the fixing device comprising an endless belt for heating a toner image, formed on the envelope, in a nip portion, a driving rotatable member, forming the nip portion in cooperation with the endless belt, for rotationally driving the endless belt, a pad for pressing the endless belt at an inner surface toward the driving rotatable member, the pad including a base portion, a first projecting portion projecting from the base portion toward the driving rotatable member at an upstream end in a feeding direction of the envelope, and a second projecting portion projecting from the base portion toward the driving rotatable member at a downstream end in the feeding direction of the envelope, wherein, when the fixing process is performed on the envelope, the inner surface of the endless belt is in contact with both of the first projecting portion and the second projecting portion, and is spaced from the base portion located between the first projecting portion and the second projecting portion in the feeding direction of the envelope.

Figure 5:
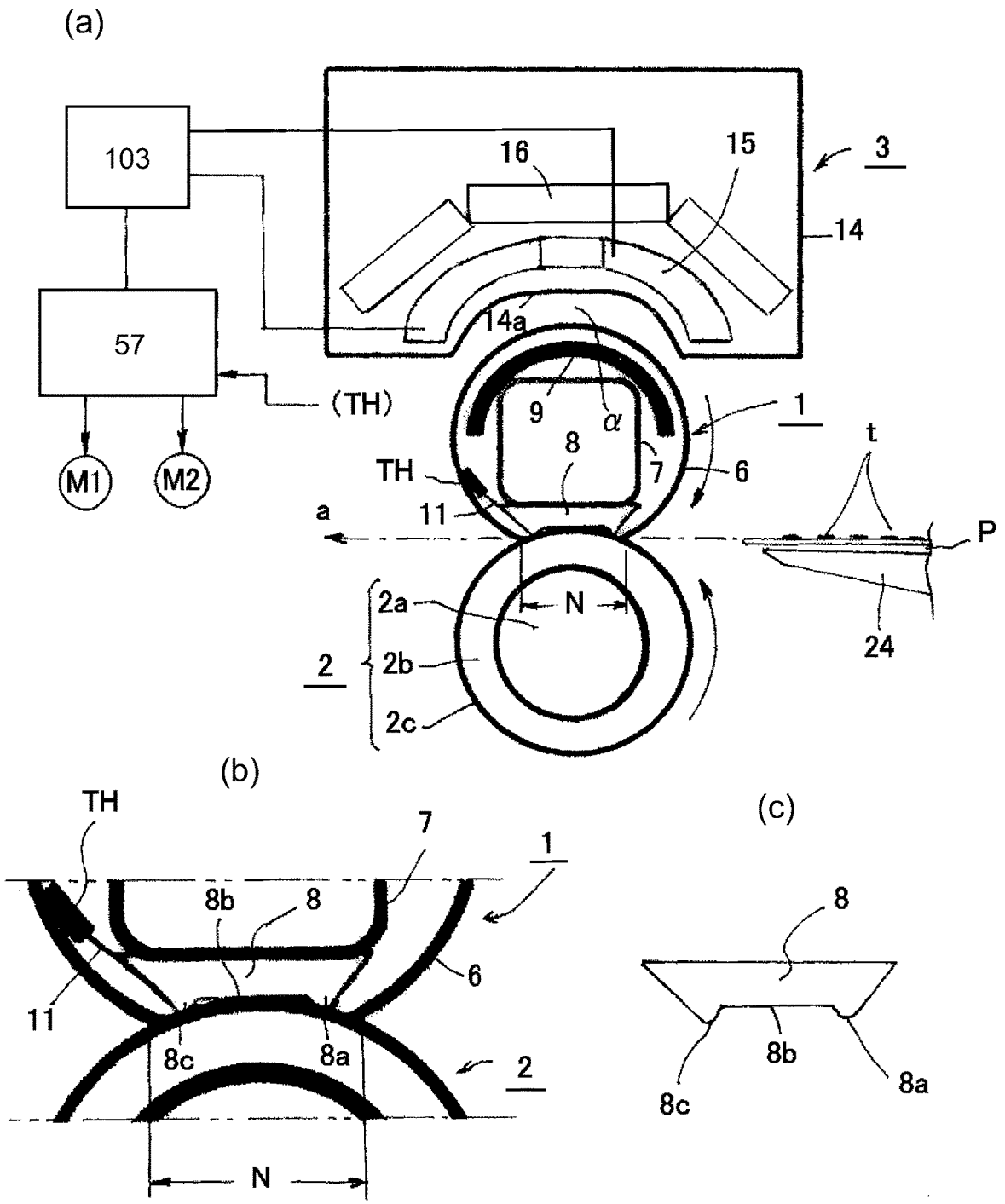

Part (a) of FIG. 5 is a transverse sectional view of a major part of the fixing device, (b) is a partially enlarged view of part (a), and part (c) thereof is a cross-sectional view of a pressure pad.

Figure 6:
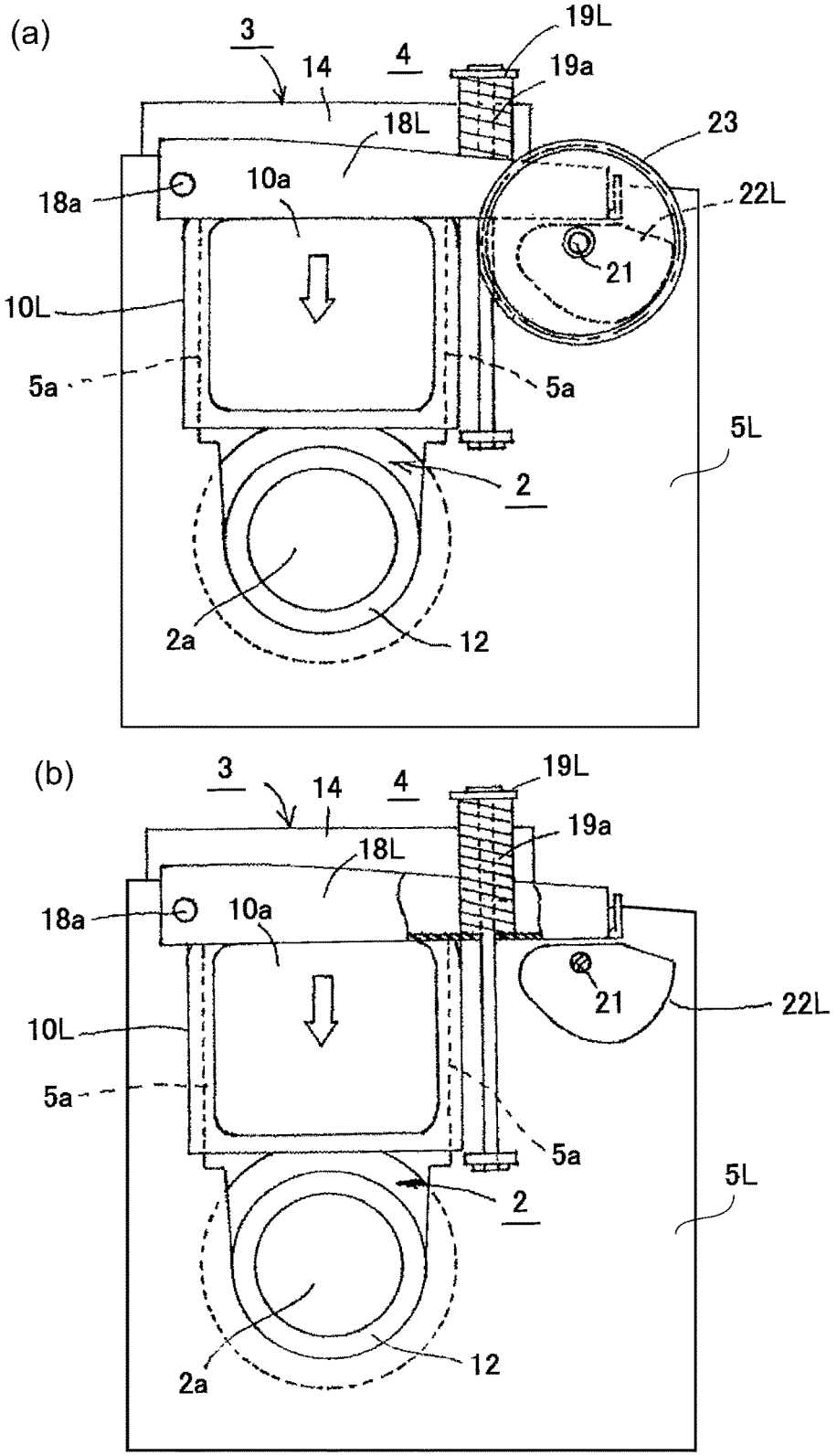

Part (a) of FIG. 6 and part (b) of FIG. 6 are a left side view of the fixing device and a left side view of a partly cut-away portion, respectively.

Figure 7:
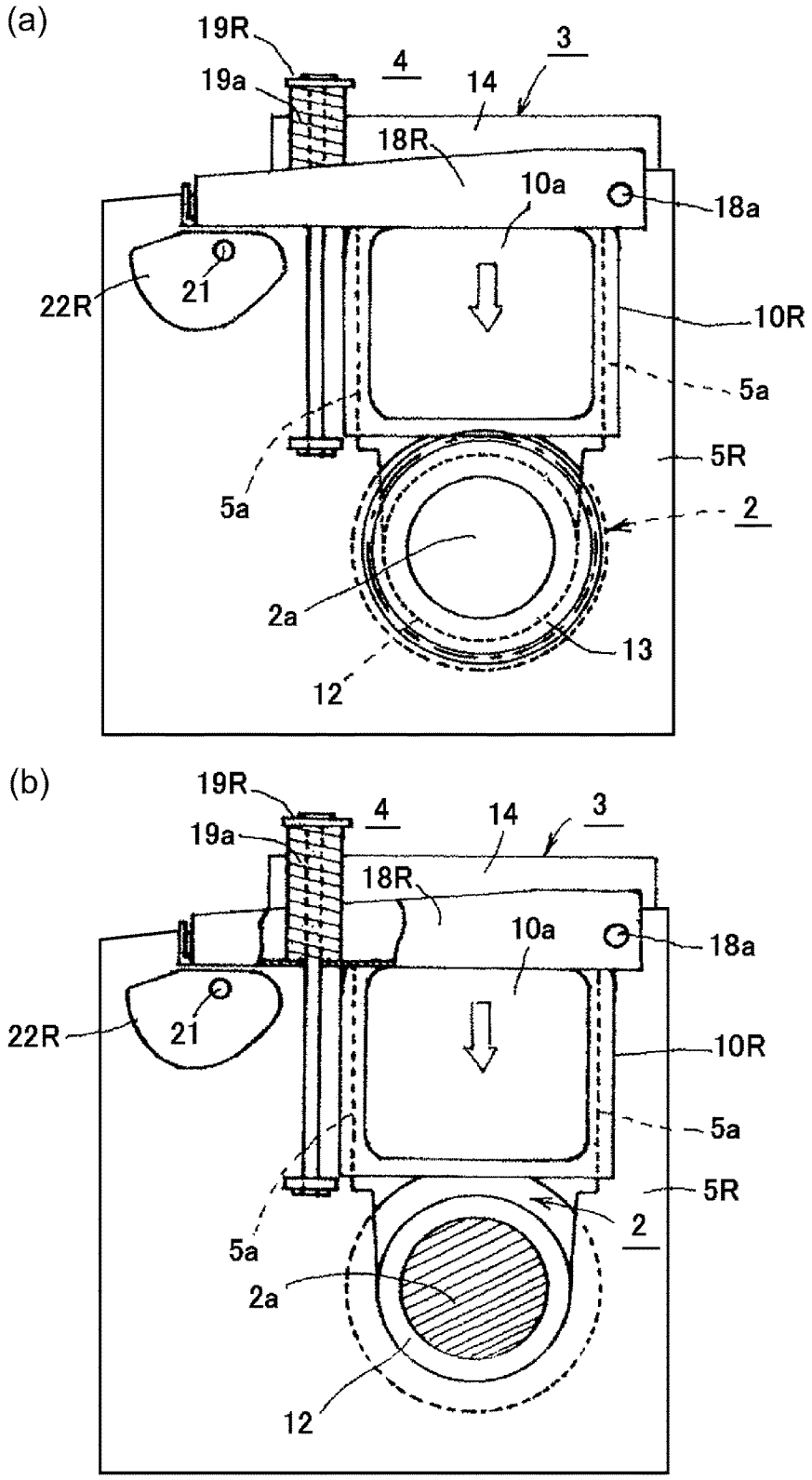

Part (a) of FIG. 7 and part (b) of FIG. 7 are a right side view of the fixing device and a right side view of a partly cut-away portion, respectively.

Figure 8:
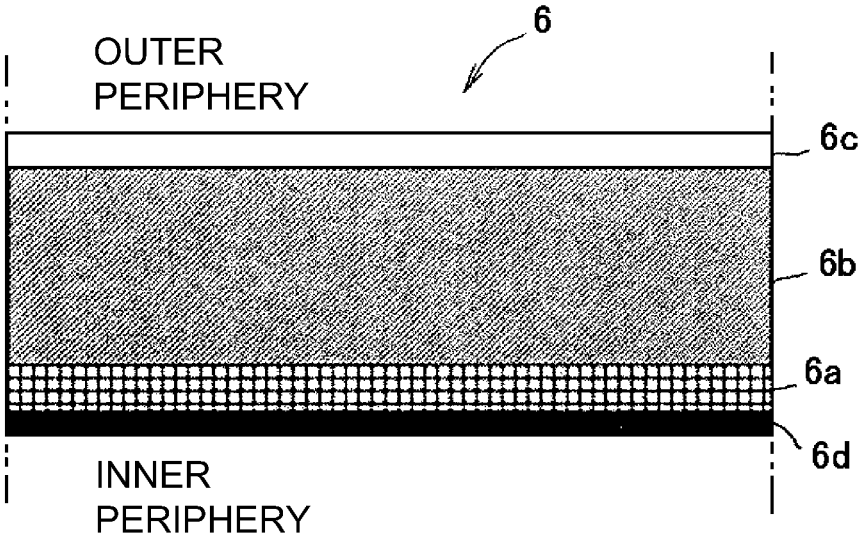

FIG. 8 is a schematic view of a layer structure of the fixing belt.

Figure 9:
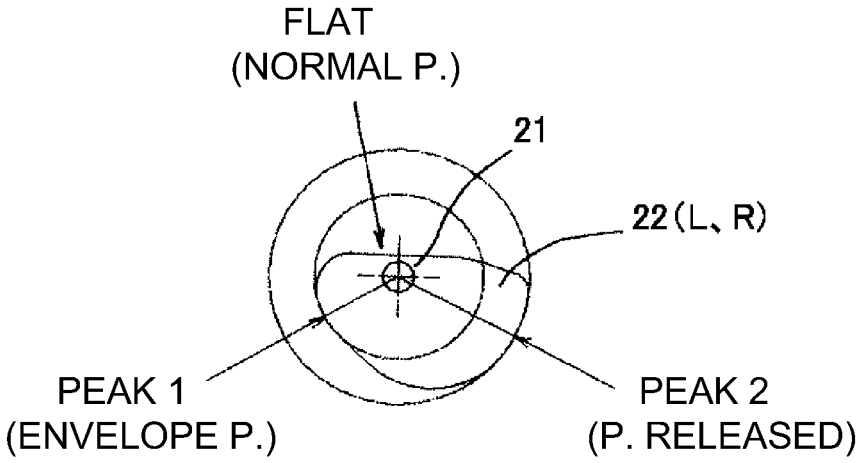
Figure 9:
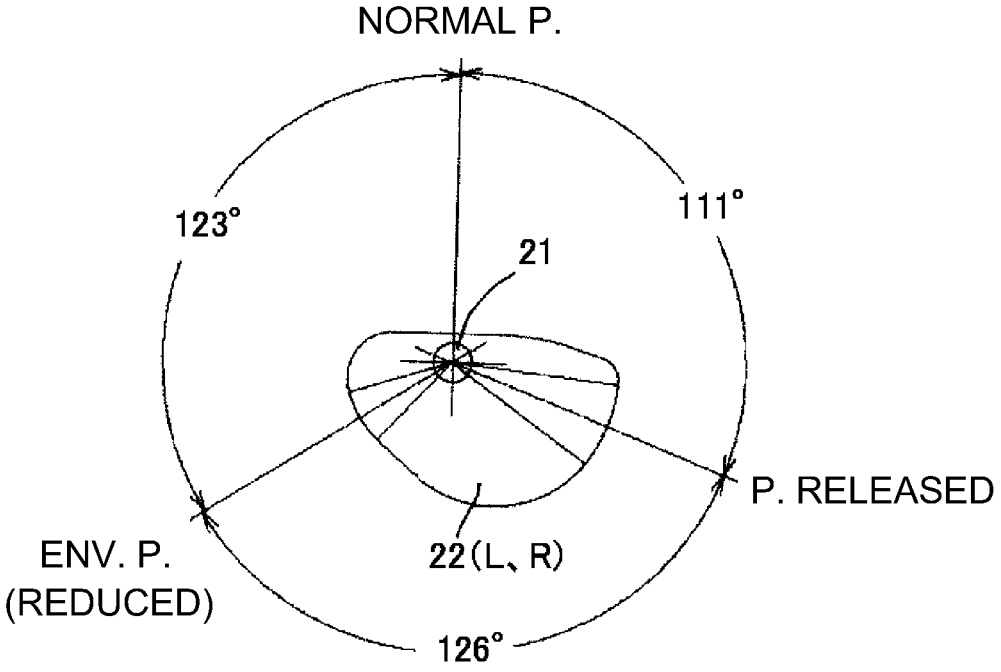

FIG. 9 is an illustration of the shape of an eccentric cam.

Figure 10:
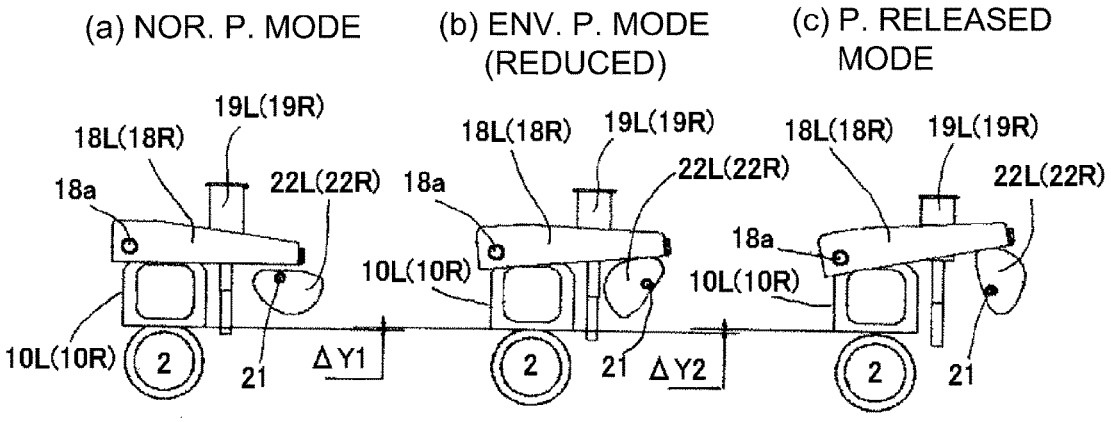

FIG. 10 is an illustration of the position of the belt unit in the pressing structure, the pressure decreasing structure, and the pressure releasing structure.

Figure 11:
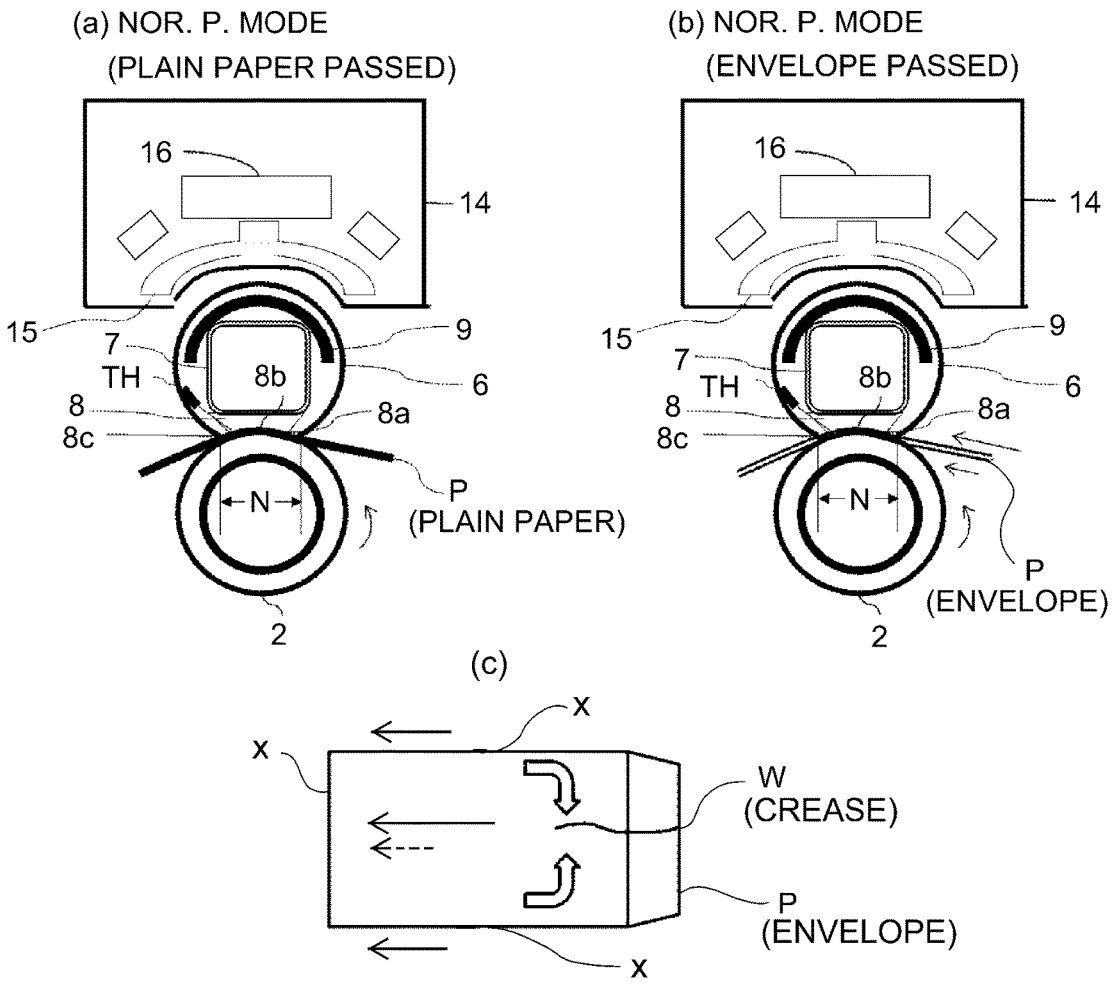

FIG. 11 is an illustration of a mechanism of production of an envelope crease in a normal pressure mode (first pressure mode).

Figure 12:
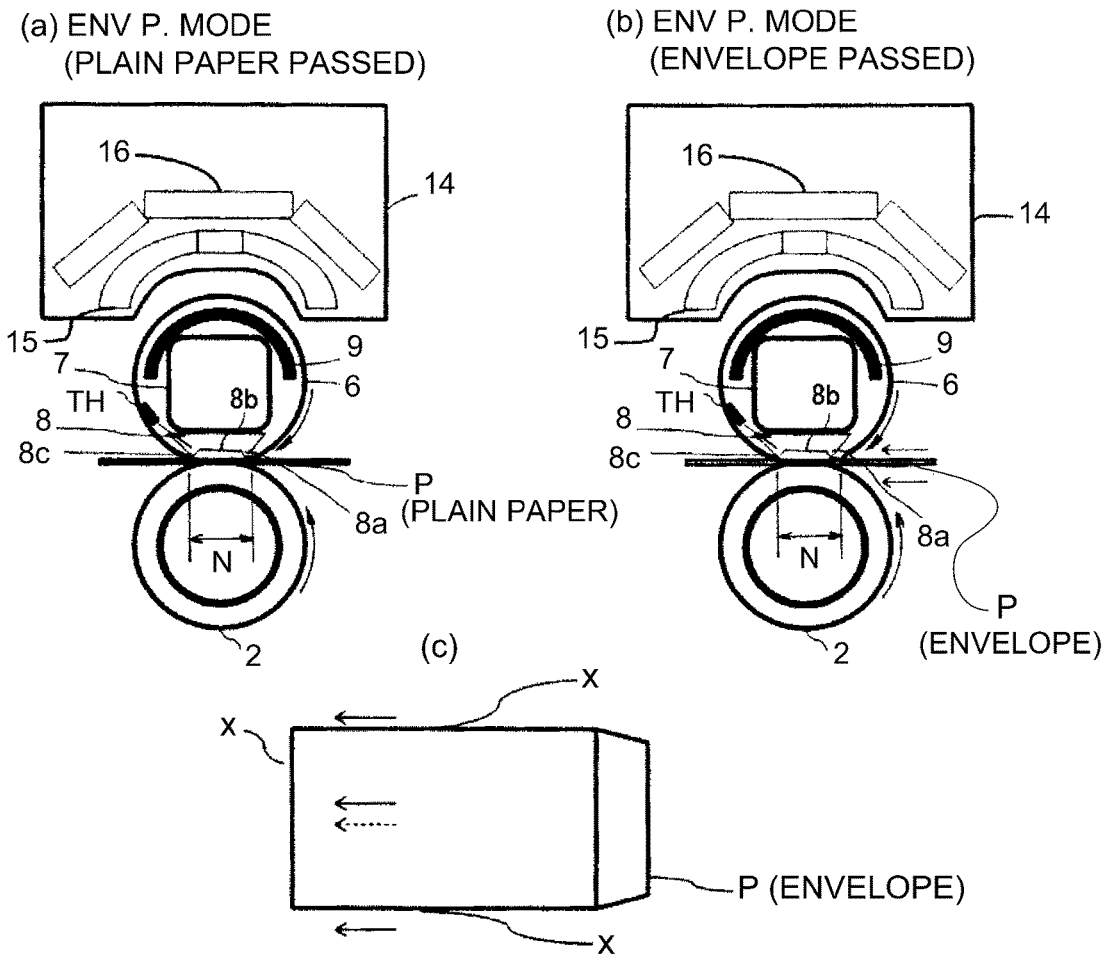

FIG. 12 is an illustration of a mechanism of production of an envelope crease in a envelope pressure mode (second pressure mode).

Figure 13:
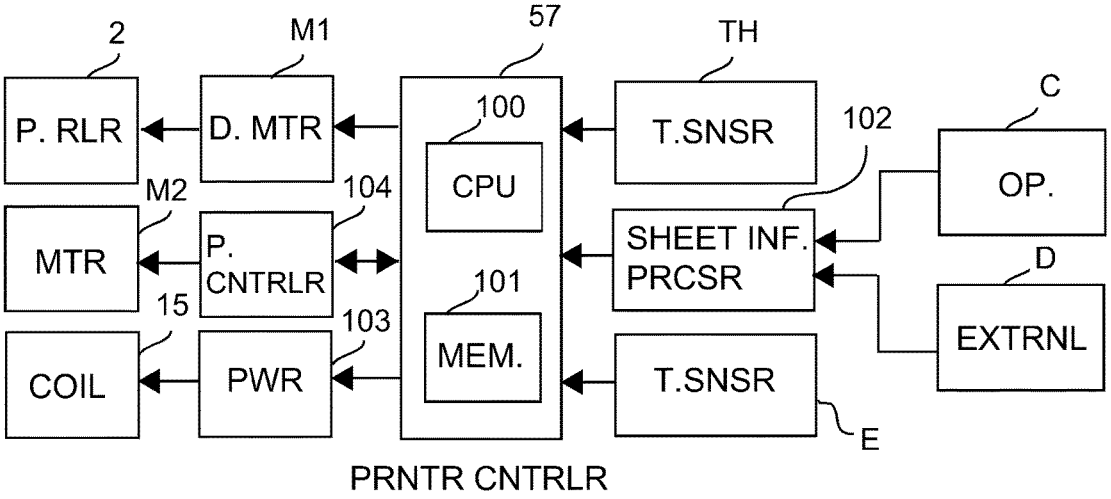

FIG. 13 is a block diagram of a control system.

Figure 14:
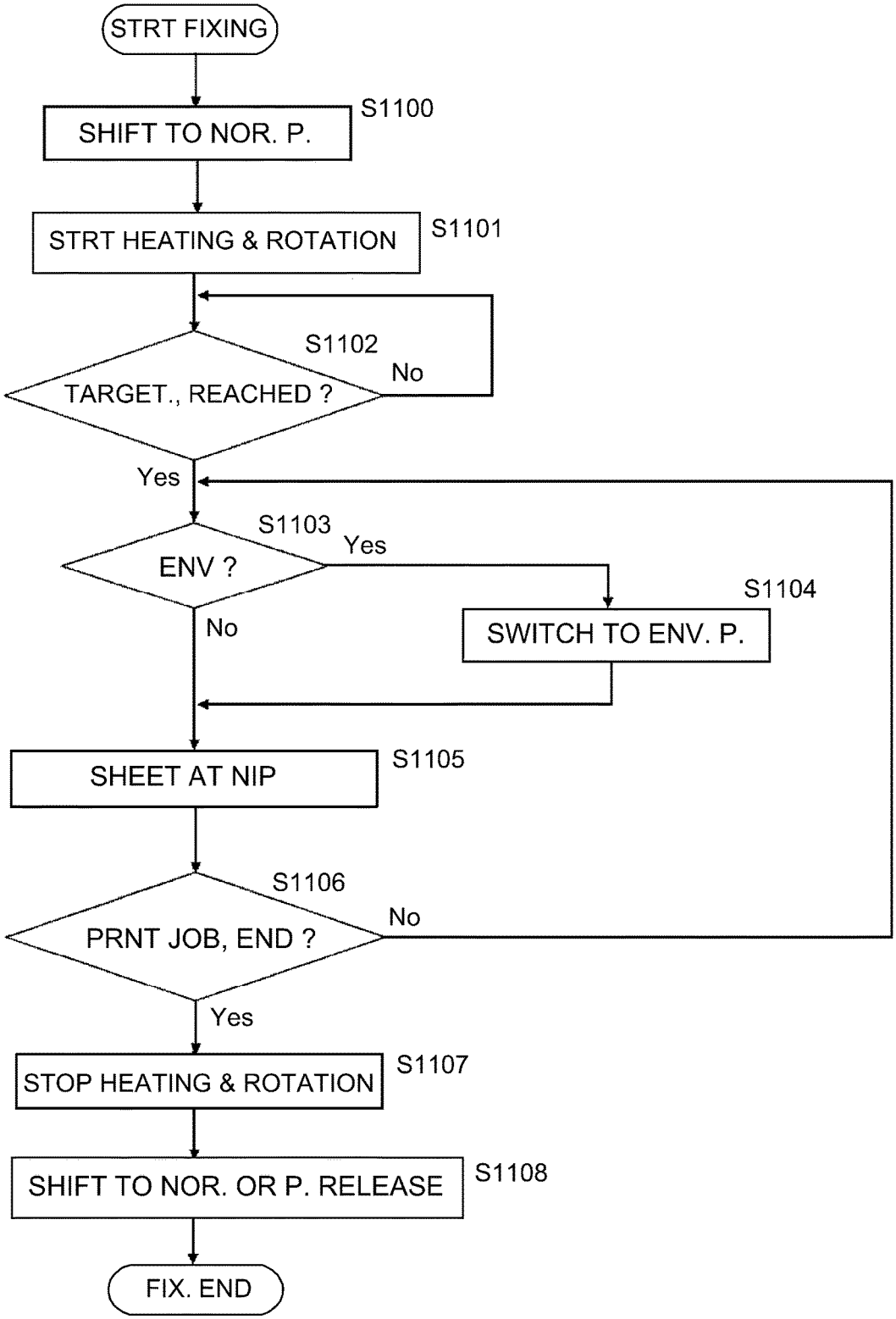

FIG. 14 is a control flowchart of the fixing device.

Figure 15:
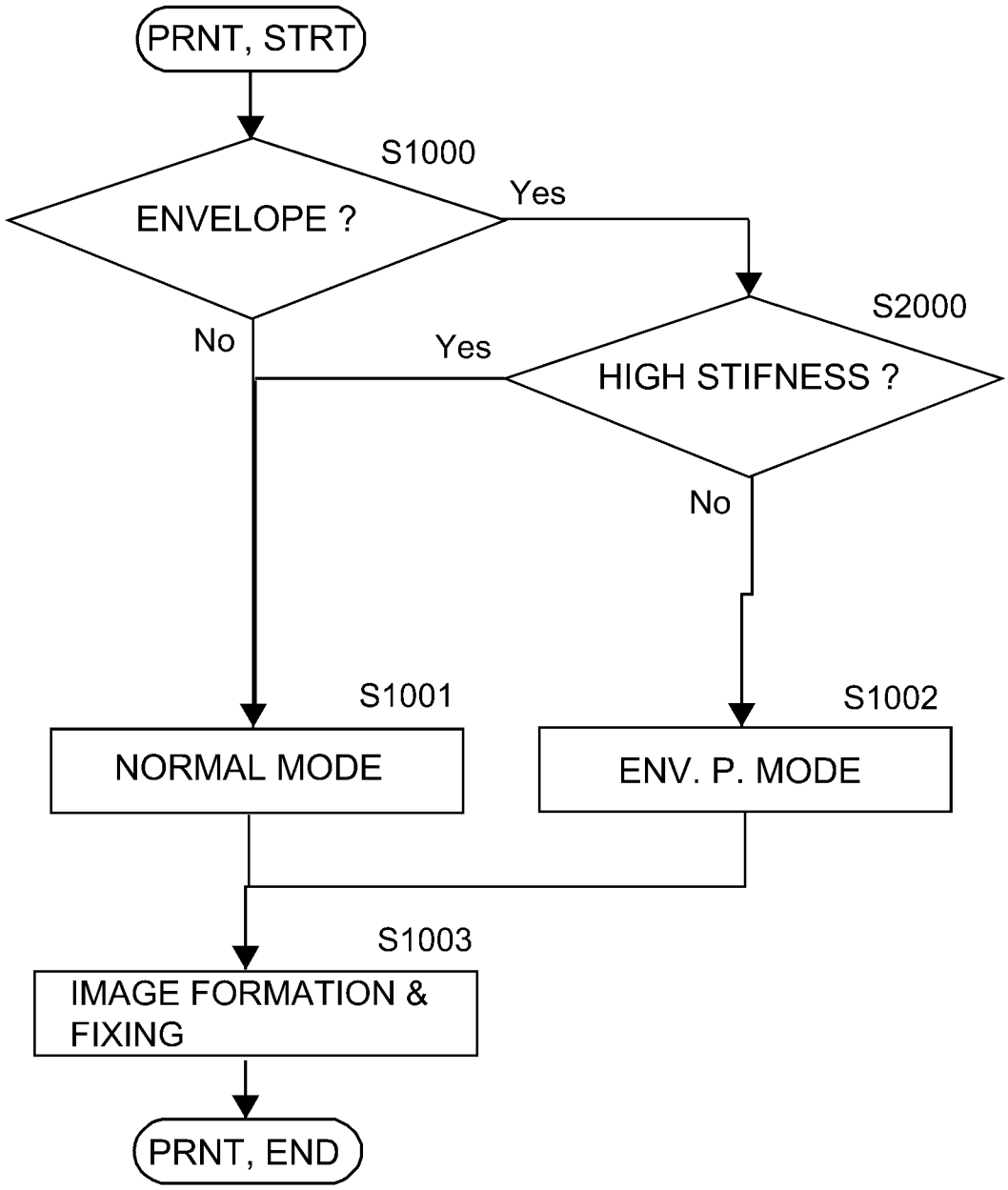

FIG. 15 is a control flowchart of the control in Embodiment 2.

Figure 16:
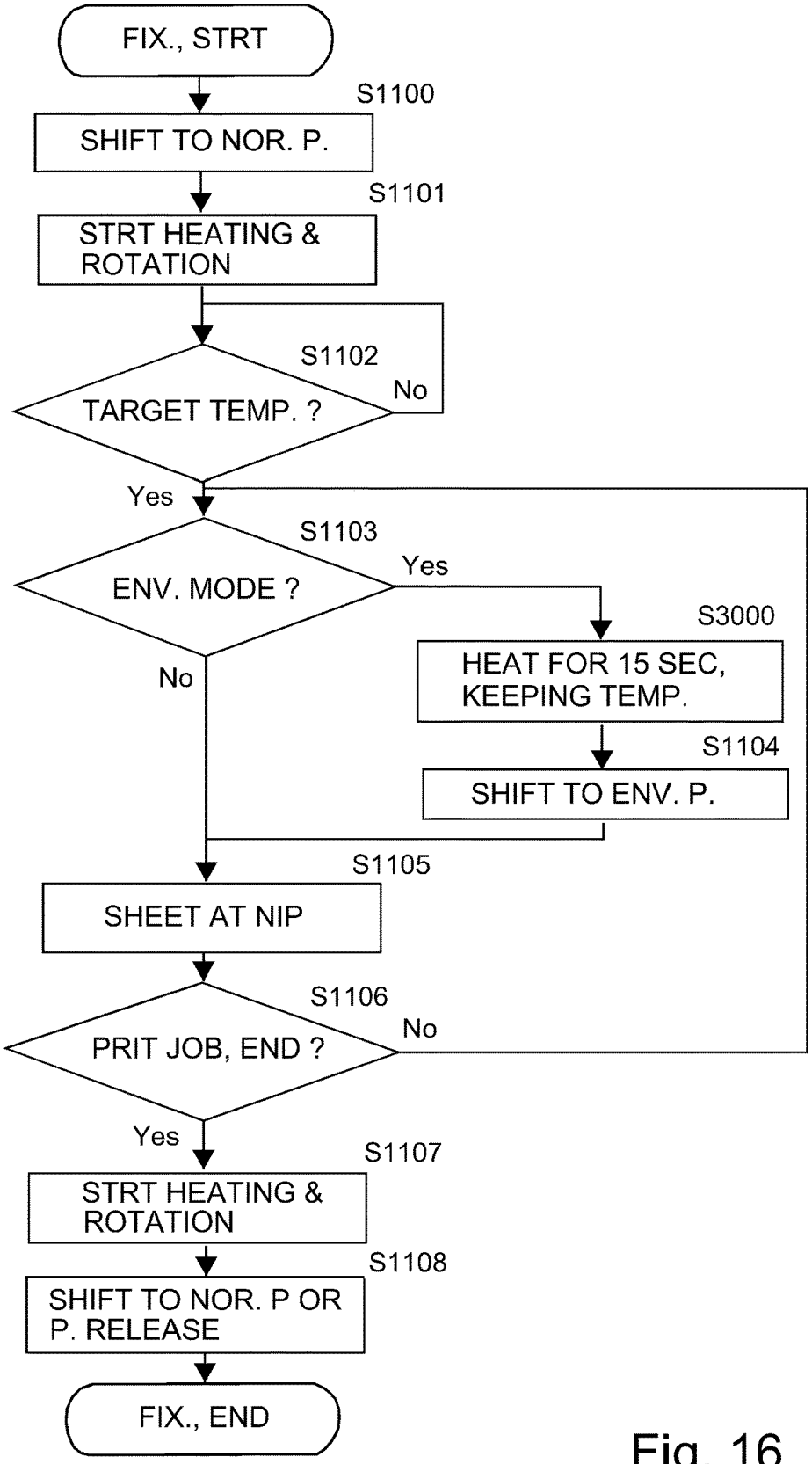

FIG. 16 is a control flowchart of the control in Embodiment 3.

Figure 17:
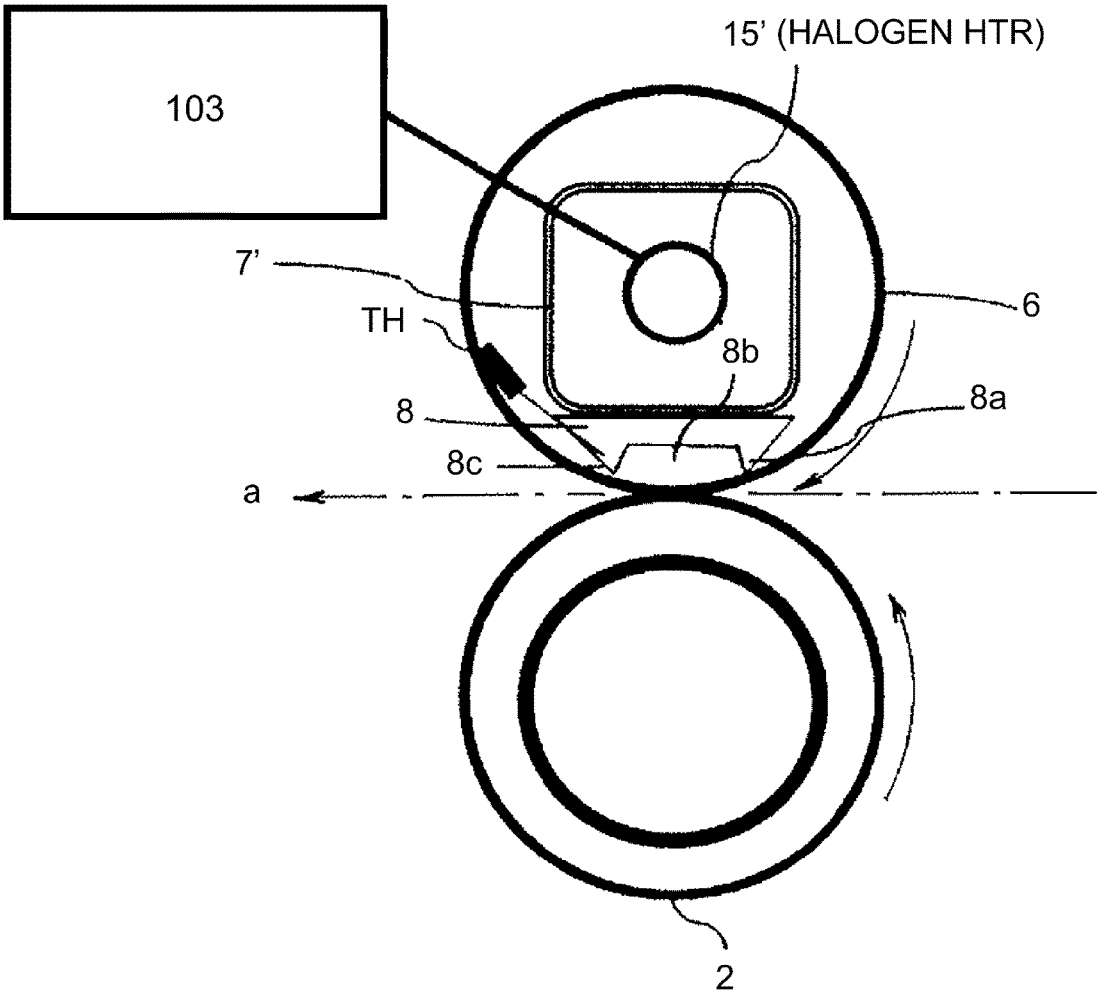

FIG. 17 is a view illustrating the structure of the fixing device according to Embodiment 6.

Figure 18:
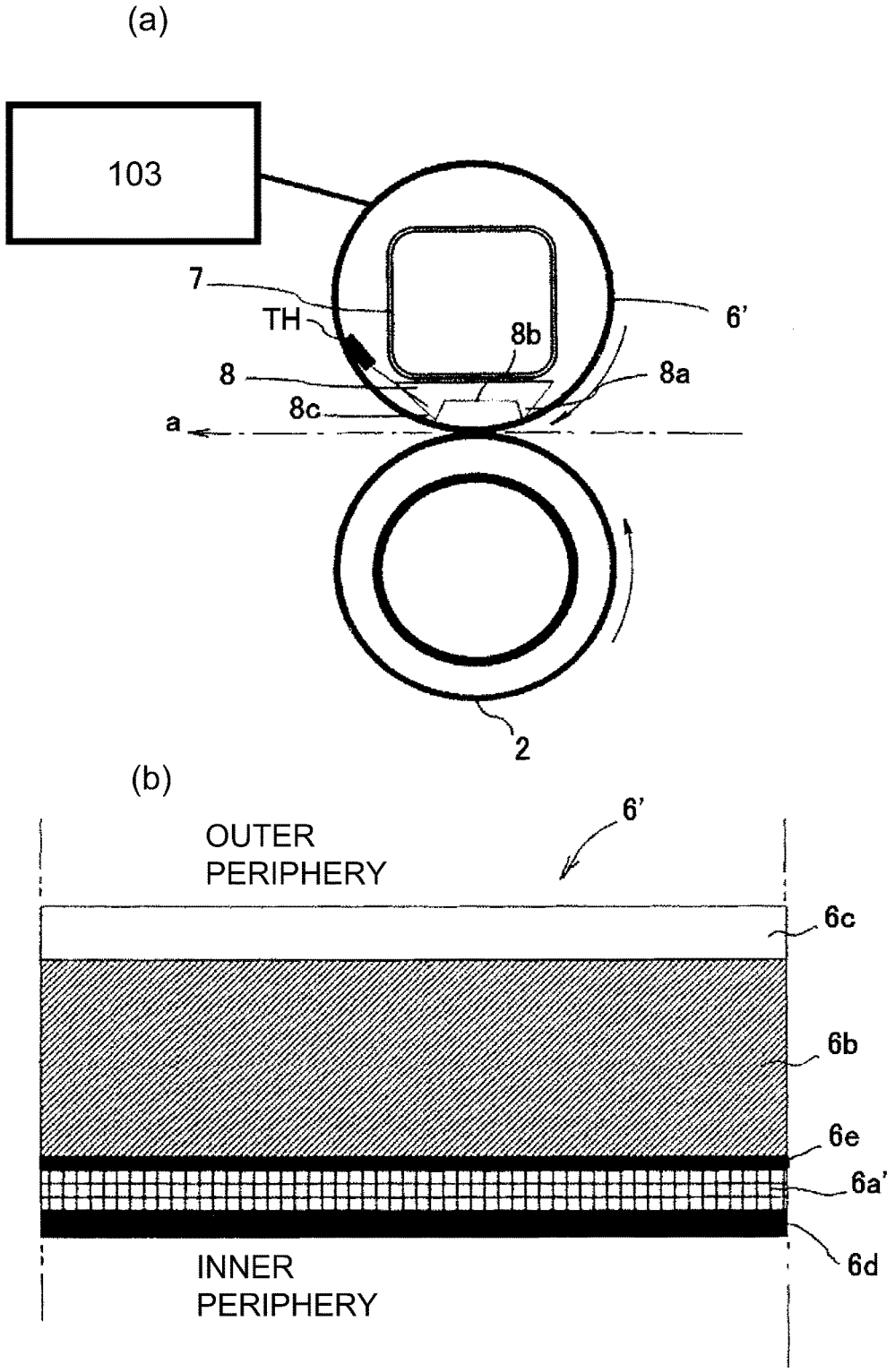

FIG. 18 is a view illustrating the structure of the fixing device according to Embodiment 7.

Figure 19:
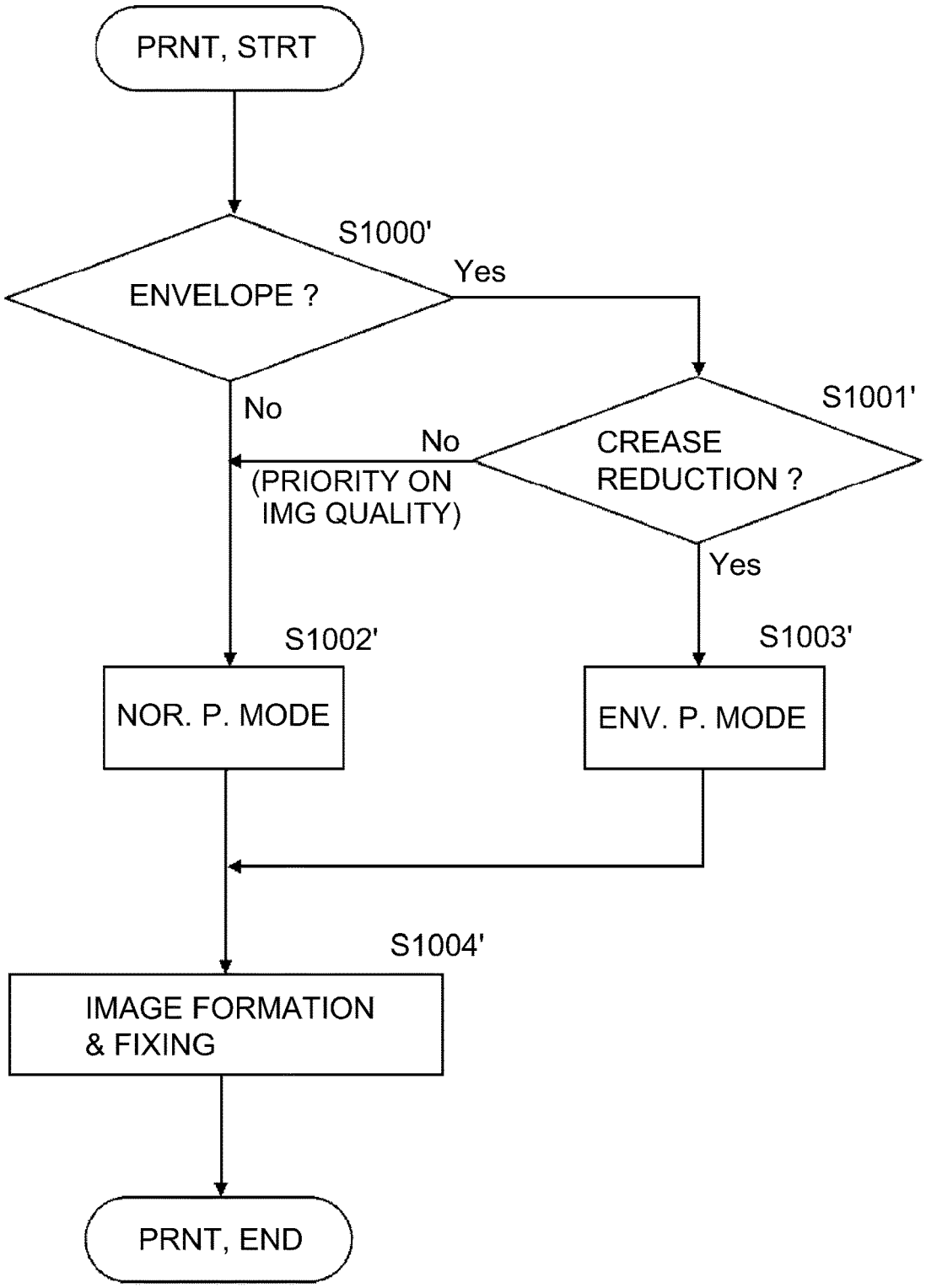

FIG. 19 is a flowchart illustrating the control of in Embodiment 4.

Figure 20:
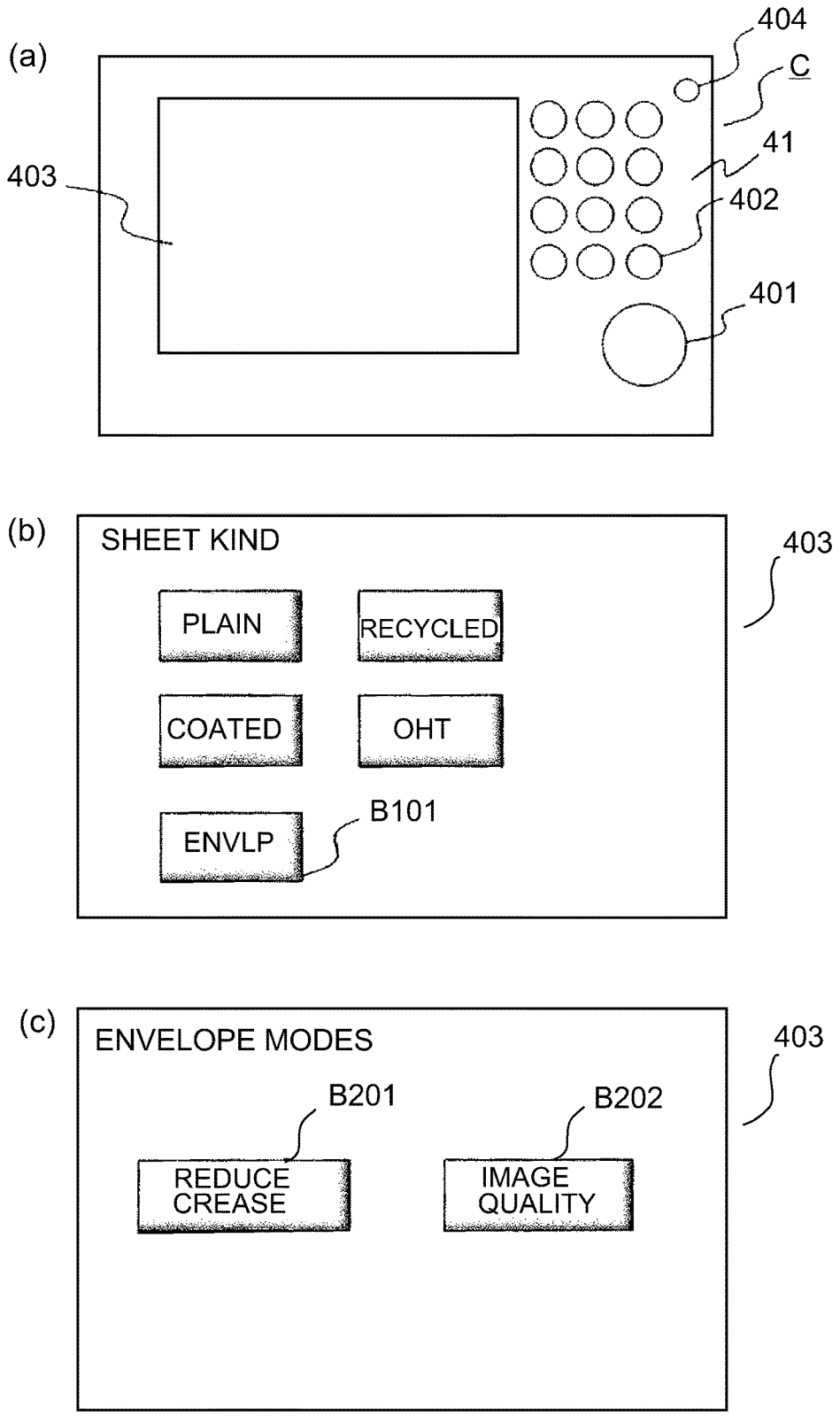

FIG. 20 is a diagram showing a display state of an operation portion.

DETAILED DESCRIPTION OF THE INVENTION

Hereafter, embodiments of the present invention will be described in conjunction with the accompanying drawings. In the following description, an example of an electrophotographic color copying machine including a plurality of drums will be described as an image forming apparatus. The present invention is not, however, limited to this description, and can be applied to various types of electrophotographic copying machines, printers, monochromatic types, and image forming apparatuses of a type other than the electrophotographic type.

In the following description, an envelope-like recording material refers to a recording material of a bag-like body, including a plurality of folded overlapping portions, as in envelopes, hereafter simply referred to as an envelope. A recording material other than an envelope shape means a sheet of normal paper, including transparency paper, hereafter simply referred to as plain paper sheet. In addition, these recording media may be collectively referred to as sheets, too.

Embodiment 1

(1) Example of Image Forming Apparatus

Figure 2:
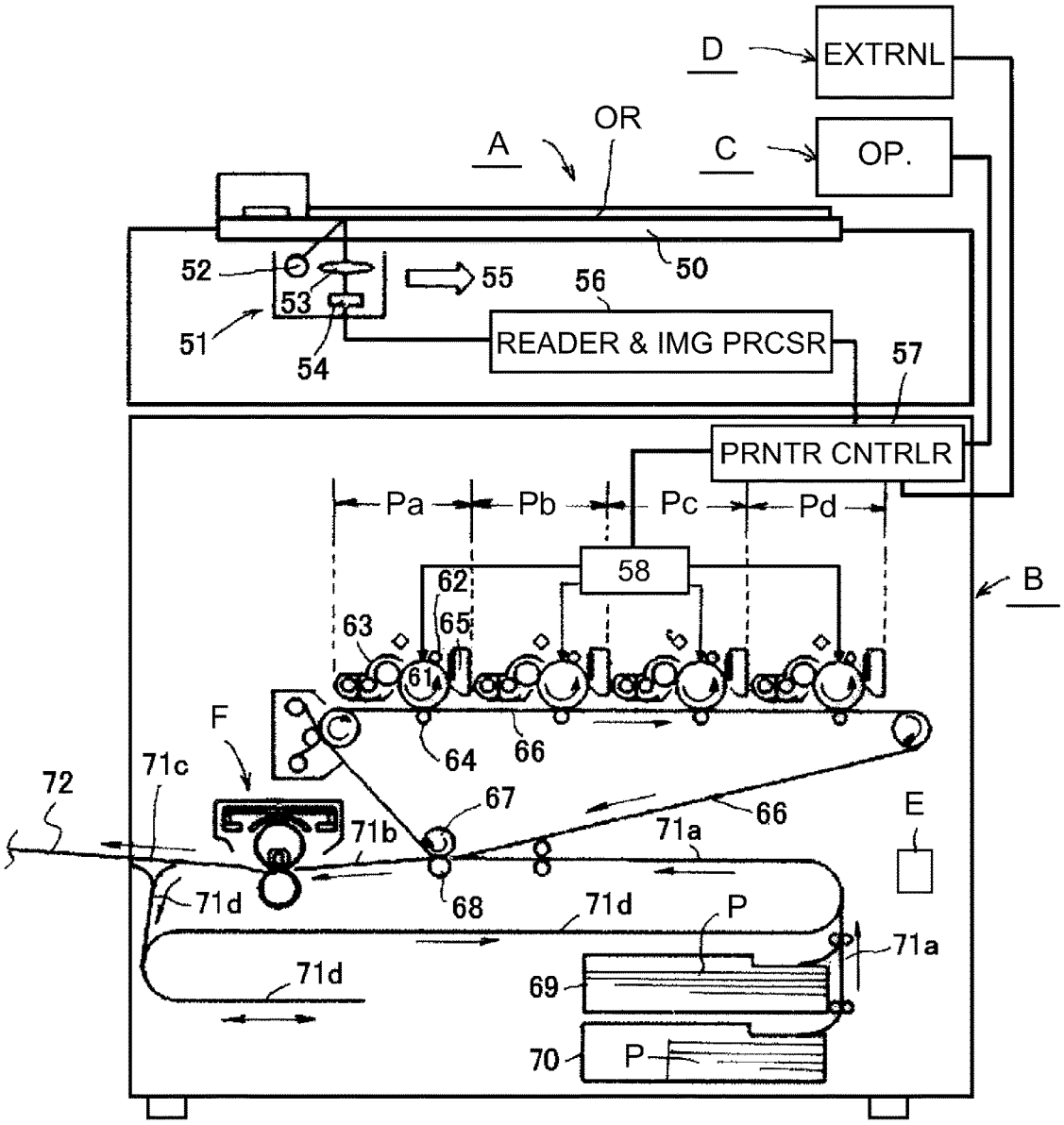
FIG. 2 is a structural model diagram of an example of the image forming apparatus.

FIG. 2 is a schematic structure diagram of a color copying machine according to this embodiment. Designated by A is a reader portion, B is a printer portion, C is an operation portion, and D is an external device, such as a PC (personal computer) or a print server. The image information of an original OR is photoelectrically read by the reader portion A, the printer portion B forms an image corresponding to the read image information on paper (or sheet) P, and outputs the sheet P as an image-formed product.

In the reader portion A, the original OR, placed on an original placing glass 50, is irradiated by a light source 52 of a reading optical system unit 51, and is imaged on a charge coupled device (CCD) sensor 54 through an optical system 53. The reading optical system unit 51 moves (sub-scanning movement) in the direction of an arrow 55 to photoelectrically read the image information of the original OR, and to convert the image information into an electrical signal data string for each line. The image signal obtained by the CCD sensor 54 is fed to a printer control portion (i.e., an execution portion, also hereafter referred to as control portion) 57 of the printer portion B through a reader image processing portion 56, and is sent to the control portion 57, which processes the image signal correspondingly to the printer portion B. The control portion 57 also receives external input from the external device D as an image signal.

Information (size, basis weight, type, and so on) of the paper type (recording material type) to be used can be set in the control portion 57, using the operating portion C or the external device D as the input portion. The control portion 57 can reflect the information, such as the paper type and basis weight, from these set information (recording material setting information) in the operation control of the printer portion B.

Next, the printer portion B will be described. The image signal from the reader image processing portion 56 is converted to a laser beam that is Pulse Width Modulated (PWM) by the control portion 57. A polygon scanner 58 deflects the laser beam and irradiates a photosensitive drum 61 of image forming portions Pa to Pd. More specifically, Pa is a yellow (Y) image forming portion, Pb is a magenta (M) image forming portion, Pc is a cyan (C) image forming portion, and Pd is a black (Bk) image forming portion.

The mechanism and the structure of the image forming portions Pa to Pd are substantially the same. Therefore, in the following description, the Y image forming portion Pa will be described as a representative image forming portion, and reference characters and descriptions will be omitted for other image forming portions Pb to Pd.

In the Y image forming portion Pa, an electrostatic latent image is formed on the surface of the photosensitive drum 61 by the laser beam from the polygon scanner 58. Designated by 62 is a primary charger that prepares the electrostatic latent image formation by charging the surface of the photosensitive drum 61 to a predetermined potential. Designated by 63 is a developing portion that develops the electrostatic latent image on the photosensitive drum 61 to form a toner image. Designated by 64 is a transfer roller (roll) that electrically discharges at the back side of an intermediary transfer belt 66 and applies a primary transfer bias having a polarity opposite to that of the toner. As a result, the toner image on the photosensitive drum 61 is transferred onto the intermediary transfer belt 66. After the transfer of the toner image, the surface of the photosensitive drum 61 is cleaned by a cleaner 65.

The toner image on the intermediary transfer belt 66 is sequentially fed to the next image forming portions Pb to Pd, and the toner images of the respective colors formed by the image forming portions Pb, Pc, and Pd are sequentially transferred in the order of M, C, and Bk, and an image of four color superimposition is formed on the surface of the intermediary transfer belt 66. The toner image, having passed through the Bk image forming portion Pd, is fed to the secondary transfer portion comprising a secondary transfer inner roller 67 and a secondary transfer outer roller 68. Then, in the secondary transfer portion, the toner image on the intermediary transfer belt 66 is secondarily transferred onto the paper P by a secondary transfer electric field having a polarity opposite to that of the toner.

The paper P is stored in a sheet feed cassette 69 or 70, the sheet feed cassettes 69 and 70 serving as a plurality of recording material containers in which paper corresponding to a preselection is stored. The sheets P are fed one by one from the sheet feed cassette 69 or 70, are fed by a feeding path 71*a*, and are introduced into the secondary transfer portion at predetermined control timing.

The sheet P, having passed through the secondary transfer portion, is fed along a feeding path 71*b*, and is introduced into the fixing device (fixing portion, fixing device) F, in which the sheet P is subjected to fixing processing of the toner image. In the case of a single-sided printing mode, the sheet P that has left the fixing device F is guided by a feeding path 71*c* and is discharged as single-sided printing on a discharge tray 72.

In the case of a duplex printing mode, the sheet P, on which the single-side image has been formed, exits the fixing device F, is introduced into a duplex feeding path 71*d*, and is switched back to be reintroduced into the feeding path 71*a*. As a result, the sheet P is reintroduced into the secondary transfer portion in a state in which the sheet P is reversed in its facing orientation. Thereafter, the sheet P is fed along the same feeding path as in the case of the single-sided printing mode, and is discharged as duplex printing on the discharge tray 72.

(2) Fixing Device

Figure 3:
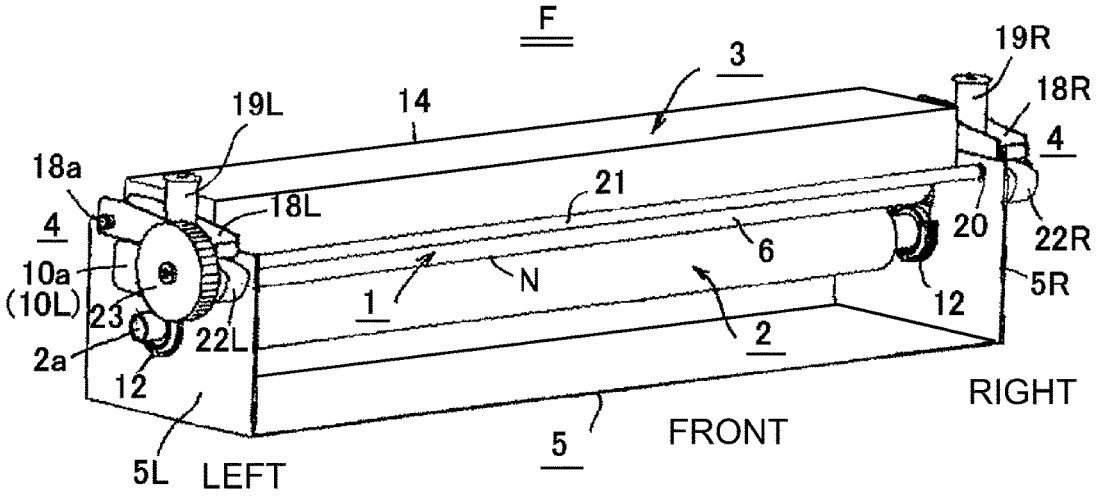
FIG. 3 is a perspective view of a fixing device.
Figure 4:
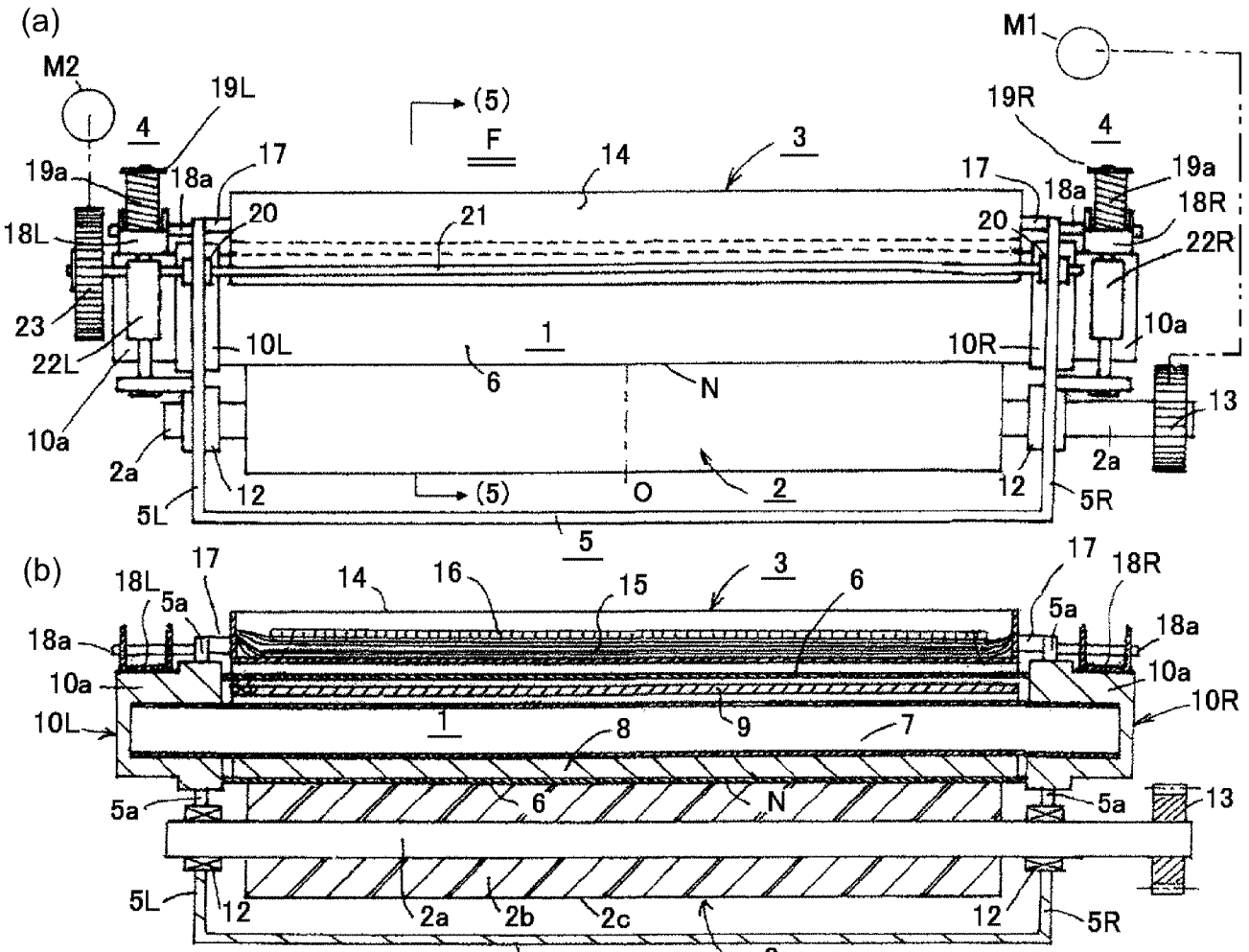
In FIG. 4, part (a) is a front view of the fixing device, and part (b) is a longitudinal front view of the fixing device.

FIG. 3 is a perspective view of the fixing device F, and parts (a) and part (b) of FIG. 4 are a front view and a longitudinal sectional front view, respectively, of the fixing device F. Part (a) in FIG. 5 is an enlarged right side view taken along line (5)-(5) in part (a) of FIG. 4. Part (b) of FIG. 5 is a partially enlarged view of part (a). Part (c) of FIG. 5 is a transverse sectional view of the pressure applying member (pressure pad). The parts (a) and part (b) in FIG. 6 are a left side view and a partly cut-away left side view, respectively, of the same fixing device F. Part (a) and part (b) of FIG. 7 are a right side view and a partly cut-away right side view of the same device F, respectively.

In the following description, the longitudinal direction of the fixing device F, or the members constituting the fixing device F, is a direction parallel to the direction perpendicular to the sheet feeding direction a (recording material feeding direction). The lateral direction is a direction parallel to the sheet feeding direction a. As regards the fixing device F, the front face is the face seen from the sheet entrance side of the machine, the back face is the face on the opposite side (paper exit side), and the left and right sides are the left and right, respectively, when looking at the machine from the front. The upstream side and the downstream side are the upstream side and the downstream side, respectively, with respect to the paper conveyance direction a.

The fixing device F of this embodiment is a belt heating type image heating device utilizing induction heating, and generally includes the following members and mechanisms.

A: a heating assembly (belt unit) 1 including a flexible endless belt (hereafter referred to as a fixing belt or a belt) 6 as a first rotating member (fixing member) contacting the toner image carrying surface of the paper P.

B: an elastic pressure roller 2 as a driving rotatable member (pressing member) opposed to the belt 6.

C: a coil unit (induction heating device, magnetic flux generating means) 3 as a heating source for heating the belt 6.

D: a pressing mechanism 4 for forming a nip portion N for heating (image heating process; fixing) the toner image on the paper P (on the recording material) by press-contacting the belt 6 and the pressure roller 2 with each other.

E: a change mechanism for changing the pressure of the nip N applied by the pressing mechanism 4.

The above-described members and mechanisms are provided between the left and right side plates 5L and 5R of an apparatus chassis 5 of the fixing device F.

(2-1) Heating Assembly 1

The heating assembly 1 is cylindrical, and includes the flexible fixing belt 6. The belt 6 includes a magnetic member (metal layer, conductive member) that generates heat by electromagnetic induction when it passes through the region in which the magnetic field (magnetic field, magnetic flux) generated from the coil unit 3 is present. In addition, the heat assembly 1 has a metal stay 7 inserted inside the belt 6. On a lower surface of the stay 7, a pressing pad (nip pad) 8, as a pressure applying member extending in the longitudinal direction, is mounted.

The pad 8 is a member for forming a nip portion (fixing portion, fixing nip portion) N pressed by a predetermined pressing force applied between the belt 6 and the pressure roller 2, and is made of heat resistant resin. As for the pad 8, as shown in part (b) and part (c) of FIG. 5, the facing portion opposed to the inner surface of the belt 6 in the cross portion of the pad 8 has an upstream side projecting portion 8*a*, a main pressure portion 8*b*, and a downstream side projecting portion 8*c*. More specifically, the pad 8 has a projection as the upstream side projecting portion 8*a* at the upstream portion of the nip portion N, and a projection as the downstream side projecting portion 8*c* at a downstream portion of the nip portion N. The pad 8 has a main pressure portion 8*b* between the projecting portions 8*a* and 8*c*. The main pressure portion 8*b* does not necessarily need to be flat. It will suffice if the main pressure portion 8*b* is farther from the inner surface of the belt 6 than a plane connecting the free end of the upstream side projecting portion 8*a* and the free end of the downstream side projecting portion 8*c*.

More specifically, the pad 8 is a pressure applying member constituted to apply pressure to the pressure roller 2 via the belt 6 to form the nip portion N. And, the pad 8 includes, in cross section, the main pressure portion 8*b* in the neighborhood of the center of the nip portion N at the portion facing the inner surface of the belt 6, and protruding portions 8*a* and 8*c* projecting from the main pressure portion 8*b* toward the belt 6 on the upstream side and the downstream side, respectively, in the paper feeding direction a with the main pressure portion 8*b* in the middle. The pad 8 has a crown shape in order to correct deflection when applying pressure. As the crown amount usable with this example, the difference between the longitudinal center of the pad 8 and the end (position 200 mm from the center) is 1.6 mm.

The stay 7 needs stiffness in order to apply pressure to the nip portion N. Therefore, in this embodiment, the stay 7 is made of iron. A magnetic core (inner magnetic core) 9 for concentrating the induction magnetic field on the belt 6, to efficiently heat the belt 6, is extended in the longitudinal direction of the stay 7 in the upper side (the coil unit 3 side) of the stay 7.

The left and right end portions of the stay 7 project outwardly beyond the left and right end portions of the belt 6, respectively. Flange members (fixing flanges) 10L and 10R including symmetrical shapes are fitted respectively to end portions thereof. The flange members 10L and 10R are regulating members for regulating the movement of the belt 6 in the longitudinal direction (i.e., a width direction or a lateral direction) and for regulating the circumferential shape. The belt 6 is loosely fitted around the assembly including the stay 7, the pad 8, and the core 9. The movement of the belt 6 in the longitudinal direction is restricted by the inwardly facing surfaces of the flange members 10L and 10R.

In the belt 6, as will be described later, the base layer 6*a* (FIG. 8) is made of a metal including the property of generating electromagnetic induction heat. Therefore, as a means for regulating the deviation in the longitudinal direction of the belt 6 in the rotating state, it is enough to provide the flange members 10L and 10R including the flange portion having the function of simply receiving the end portion of the belt 6. This provides the advantage that the structure of the fixing device F can be simplified.

A temperature sensor TH, such as a thermistor serving as temperature detecting means (temperature detecting element), for detecting the temperature of the belt 6, is provided at the longitudinal center portion of the pad 8 by way of an elastic supporting member 11. The sensor TH is elastically in contact with the inner surface of the belt 6 by the member 11. As a result, the sensor TH keeps a good contact with the inner surface of the belt 6, even if the sensor contact surface of the rotated belt 6 causes position fluctuation due to waving, or the like.

The flange members 10L and 10R of the heating assembly 1 are respectively engaged with the longitudinal guide slit portions 5*a* formed in the side plates 5L and 5R. Therefore, the entire heating assembly 1 can move vertically along the slit portion 5*a* between the side plates 5L and 5R.

FIG. 8 is a model diagram showing the layer structure of the belt 6. In this embodiment, the belt 6 has an inner diameter of 30 mm and includes a nickel base layer (magnetic member, metal layer) 6*a* manufactured by an electroforming method. The thickness of the base layer 6*a* is 40 μm. A heat-resistant silicone rubber layer is provided as an elastic layer 6*b* on the outer periphery of the base layer 6*a*. The thickness of the layer 6*b* is preferably in the range of 100 μm to 1000 μm.

In this example, the thickness of the layer 6*b* is 300 μm, in order to shorten the warming up time by reducing the heat capacity of the belt 6 and to provide a fixed image suitable in fixing a color image. Silicone rubber, having a hardness of JIS-A 20 degrees and a thermal conductivity of 0.8 W/mK, may be used as the layer 6*b*. In addition, a fluorocarbon resin layer (for example, a layer formed of perfluoroalkoxy alkane (PFA) or polytetrafluoroethylene (PTFE)) with a thickness of 30 μm is provided as the surface parting layer 6*c* on the outer periphery of the layer 6*b*.

On the inner surface side of the base layer 6*a*, a resin layer (slipping layer) 6*d*, formed of a material, such as fluororesin or polyimide, may have a thickness of 10 μm to 50 μm in order to lower the sliding friction between the belt inner surface and the sensor TH. In this example, the layer 6*d* is polyimide having a thickness of 20 μm.

The belt 6 has a low heat capacity as a whole and is flexible (elastic). In its free state, it has a cylindrical shape. In addition to nickel, iron alloys, and metals, such as copper and silver, can be used for the metal layer 6*a*. In addition, these metals may be laminated on the resin base layer 6*d*. The thickness of the metal layer 6*a* may be adjusted depending on the frequency of high-frequency current flowing through the excitation coil 15 of the coil unit 3 and the permeability and the conductivity of the metal layer 6*a*, and it is preferably about 5 μm to about 200 μm.

The pressure roller 2 is rotatably provided between the side plates 5L and 5R via a bearing 12 in the lower part of the heating assembly 1, with the axial direction being substantially parallel to the longitudinal direction of the heating assembly 1.

In this embodiment, the roller 2 includes a metal core 2*a* made of an iron alloy having a diameter of 20 mm at the center in the longitudinal direction, and a diameter of 19 mm at each of the ends, and a silicone rubber layer as the elastic layer 2*b*. The roller 2 is an elastic roller including a crown shape with an outer diameter of 30 mm. The surface thereof is coated with a 30 μm thickness of a fluororesin layer (formed of PFA or PTFE, for example) as the parting layer 2*c*. In the center portion of the roller 2 in the longitudinal direction, the hardness thereof is ASK-C70°.

The right end of the metal core 2*a* is provided with a gear 13 fixed thereto. The driving force of the driving motor M1, controlled by the control portion 57, is transmitted to the gear 13 through transmission means (not shown), so that the roller 2, as the so-called driving rotatable member, rotates in counterclockwise direction at a predetermined speed.

(2-3) Coil Unit 3

The coil unit 3 is a heater (induction heating means) for induction heating the belt 6, and is disposed on the upper side of the heating assembly 1, that is, on the side opposite to the roller 2 side of the heating assembly 1 by approximately 180 degrees. The coil unit 3 has an excitation coil (coil generating a magnetic flux) 15, a magnetic core 16, and the like, inside the elongated housing 14 along the longitudinal direction of the belt 6.

The housing 14 has a horizontally elongated box shape elongated in the left-right direction, and is a molded product made of a heat-resistant resin material (mold member of an electrically insulating resin). The bottom plate 14*a* side of the housing 14 is a surface facing the belt 6. In the cross section, the bottom plate 14*a* is curved toward the inside of the housing 14, as shown in part (a) of FIG. 5, so as to be along the substantially half circumferential range of the outer peripheral surface of the belt 6.

As for the coil unit 3, the opposite ends of the housing 14 are received by the left and right flange members 10L and 10R of the heating assembly 1, respectively by way of a bracket 17. By this arrangement, the bottom plate 14*a* of the housing 14 faces the upper surface of the belt 6 with a predetermined gap (gap) a. As for the coil unit 3, the left and right side plates of the housing 14 are clamped to the flange members 10L and 10R on the respective sides with wire springs (not shown). That is, the coil unit 3 is integrated with the heating assembly 1.

Accordingly, when the flange members 10L and 10R of the heating assembly 1 are pressed and sunk, as will be described hereinafter, the coil unit 3 also sinks while maintaining the gap α. When the flange members 10L and 10R are depressurized or released to lift up, the coil unit 3 also floats together while maintaining the gap α.

The electrical wire of the coil 15 is made of, for example, a Litz wire, and it is wound so as to face a part of the circumferential surface and a side surface of the belt 6 in a horizontal and ship bottom fashion. And, the coil 15 is fitted inside the housing 14 against the inner surface of the bottom plate 14*a* curved inwardly of the housing 14. High frequency current is applied to the coil 15 from a power supply device (excitation circuit) 103 controlled by the control portion 57.

The core 16 is an outer magnetic core (outer magnetic core) that covers the coil 15 so that the magnetic field generated by the coil 15 does not substantially leak out of the metal layer (conductive layer) of the belt 6. The core 16 is extended along the longitudinal direction of the belt 6, and is divided into a plurality of portions in a direction perpendicular to the sheet feeding direction a, and it surrounds the winding center part of the coil 15.

In order to suppress the temperature rise in the non-sheet passing portion when paper narrower than the maximum width size paper usable in the apparatus is passed, the divided core 16 corresponding to the non-sheet passing portion is moved by a moving mechanism (not shown) so as to widen the gap from the coil 6. As a result, the magnetic flux density passing through the belt 6 at the portion corresponding to the non-sheet passing portion is lowered, and the amount of heat generated at the belt portion is lowered. The movement control of this divided core 16 is not the gist of the present invention, and, therefore, a detailed explanation of the movement control will be omitted.

(2-4) Pressing Mechanism 4 and Change Mechanism

In this embodiment, the pressing mechanism 4 is a pressing means that presses the pad 8 of the heating assembly 1 to the roller 2 by way of the belt 6 with a predetermined pressing force (pressure), so that a predetermined nip portion N is formed between the belt 6 and the roller 2. In this embodiment, the pressure by the pressing mechanism 4 can be changed by the changing mechanism.

A specific mechanism structure will be described below. A pair of right and left pressure levers 18R and 18L is provided, the right and left levers 18R and 18L being elongated in the front-rear direction (paper conveyance direction), and being provided symmetrically (left-right) as pressure members on the outer upper portions of the side plates 5R and 5L, respectively.

The lever 18L is positioned above the pressed portion (portion to be pressed) 10*a* of the flange member 10L, and the rear end portion thereof is mounted to the side plate 5L so as to be rotatable in the vertical direction about a support shaft 18*a* at the rear of the flange member 10L. In other words, the lever 18L is movable in a direction in which the pressed portion 10*a* of the flange member 10L is pressed against the support shaft 18*a* as a fulcrum, or in a direction away from the pressed portion 10*a*. The front end of the lever 18L is located on the front side of the flange member 10L. The lever 18L is normally urged downward about the shaft 18*a* by the spring force of a spring 19*a* of a spring loaded screw 19L, and as urging member disposed between the lever 18L and the side plate 5L.

The lever 18R is provided above the pressed portion 10*a* of the flange member 10R, and the rear end portion thereof is rotatably mounted so as to be movable in the vertical direction about the support shaft 18*a* relative to the side plate 5R behind the flange member 10R. In other words, the lever 18R is movable in a direction in which the pressed portion 10*a* of the flange member 10R is pressed against the support shaft 18*a* as a fulcrum, or in a direction away from the pressed portion 10*a*. The front end portion of the lever 18R is disposed on the front side of the flange member 10R. The lever 18R is constantly urged downward about the shaft 18*a* by the spring force of a spring 19*a* of a spring loaded screw 19R, as an urging member disposed between the lever 18R and the side plate 5R.

When the levers 18L and 18R are in the free state, the lower surfaces of the levers 18L and 18R are sufficiently pressed against the upper surfaces of the pressed portions 10*a* of the flange members 10RL and 10R by the spring force regulated by the spring 19*a* of the spring loaded screw. In this example, this pressure is 550 N, for example. In the heating assembly 1, the stay 7 and the pad 8 are pushed down together with the flange members 10RL, 10R so that the pad 8 presses against the roller 2 against the elasticity of the elastic layer 2*b* across the belt 6.

By this pressure contact, a nip portion N having a predetermined width in the sheet feeding direction a is formed between the belt 6 and the roller 2. The pad 8 assists in the formation of the pressure profile at the nip N. The structure at this time is referred to as the pressing structure in the following description.

A cam shaft 21 is rotatably provided between the side plates 5L and 5R by the way of bearings 20 and 20. On the outside of the side plates 5L and 5R, eccentric cams (pressure releasing members) 22L and 22R having the same symmetrical shape are fixed to the left and right end portions of the shaft 21, respectively, in the same phase of the cam profile. The cam 22L is disposed below the front end portion of the pressure lever 18L. The cam 22R is disposed below the front end portion of the lever 18R.

A gear (pressure releasing gear) 23 is fixed to the left end of the shaft 21. The driving force of the pressing roller contacting/spacing motor (for example, the stepping motor) M2, controlled by the control portion 57, is transmitted to the gear 23 through the transmission unit (not shown), to control the rotation of the shaft 21, that is, the cams 22L and 22R. In other words, the control portion 57 rotates the motor M2 according to a predetermined signal to rotate the gear 23 by a predetermined amount in a predetermined direction. The shaft 21 rotates according to the rotation of the gear 23, and the cams 22L and 22R rotate accordingly.

By the rotation control of the cams 22L and 22R, the levers 18L and 18R are lifted up against the spring force of the spring 19*a* of the spring-loaded screw 19L, whereby the pressure of the pad 8 against the roller 2 is changed.

The bearings 20 and 20, the shaft 21, the cams 22L and 22R, the gear 23, and the motor M2 constitute a change mechanism for changing the pressure of the nip portion N by the pressing mechanism 4. The details of changing the pressure provided by the pressing mechanism 4 will be described later.

(2-5) Fixing Operation

In the fixing device F in the stand-by state of the image forming apparatus, the motor M1 is in the OFF state and the rotation of the roller 2 is at rest. The pressing mechanism 4 is in the pressure releasing state and the pressurization of the nip N is not effected. Power supply to coil 15 of coil unit 3 is in OFF state.

In response to the input of a print job start signal (image forming job start signal), the control portion 57, functioning as an execution portion, changes the pressing mechanism 4 to a pressed state at a predetermined control timing. As a result, the nip N is in the pressed state. In addition, the motor M1 is turned ON. As a result, the roller 2 is rotationally driven in the counterclockwise direction indicated by the arrow in part (a) of FIG. 5 at a predetermined speed.

By the rotation of the roller 2, a rotational force acts on the belt 6 by a frictional force between the surface of the roller 2 and the surface of the belt 6 at the nip portion N. The belt 6 is rotated about the outer peripheries of the stay 7, the pad 8, and the core 9, in the clockwise direction indicated by the arrow in part (a) FIG. 5 at the same speed as the rotation speed of the roller 2, while the inner surface thereof is in sliding and close contact with the bottom surface of the pad 8. A lubricant is applied to the pad 8, so that the sliding load between the belt 6 and the pad 8 is reduced. In this example, fluorine grease was used in consideration of the grease going around the end when the device is operated near the controlled fixing temperature (180 degrees).

The movement of the belt 6 in the thrust direction during the rotation is regulated by the flange portions of the left and right flange members 10L and 10R. At least at the time of execution of image formation, the belt 6 is driven to rotate as described above when the roller 2 is rotationally driven by the motor M1 controlled by the control portion 57. A peripheral speed of this rotation is almost the same as the feeding speed of the paper P carrying the unfixed toner image fed from a secondary transfer nip portion side. In the case of this embodiment, the surface rotation speed of the belt 6 is 300 mm/sec, and it is possible to fix full-color images of 70 A4 size sheets and full-color images of 49 A4R sheets, per minute.

The control portion 57 supplies an alternating current (high-frequency current) of, for example, 20 kHz to 50 kHz to the coil 15, functioning as a heating portion, from the power supply device 103. The coil 15 generates an alternating magnetic flux (magnetic field) by supplying an alternating current. The alternating magnetic flux is guided by the core 16 to the metal layer 6*a* of the belt 6 on the upper surface side of the rotating belt 6. Then, an eddy current is generated in the metal layer 6*a*, and the metal layer 6*a* self-heats (electromagnetic induction heat generation) due to Joule heat by the eddy current, and the temperature of the belt 6 rises.

That is, during rotation of the belt 6, when passing through the region where the magnetic field generated from the unit 3 exists, the metal layer 6*a* generates heat by electromagnetic induction, so that the belt 6 is heated all around to increase the temperature. The temperature of this belt 6 is detected by the temperature sensor TH. The sensor TH detects the temperature of the portion of the belt 6 that enters the paper passing area, and the detected temperature information is fed back to the control portion 57. The control portion (temperature control function portion of the control portion) 57 controls the power supplied from the power supply portion 103 to the coil 15 so that the detected temperature (information of the detected temperature) input from the sensor TH is maintained at the predetermined target temperature (information corresponding to the fixing temperature, that is, the predetermined temperature).

That is, when the temperature detected by the belt 6 rises to a predetermined temperature, the current to the coil 15 is cut off. In this example, temperature control is carried out by controlling the power input to the coil 15 by changing the frequency of the high frequency current based on the detected temperature of the sensor TH so that the temperature of the belt 6 is constant at 180 degrees, which is the target temperature. The target temperature may be changed based on the paper temperature (recording material temperature) predicted from a temperature and humidity sensor E (FIG. 2) provided in the main assembly of the image forming apparatus.

In this embodiment, the electrical insulation state is maintained between the belt 6 and the coil 15 of the coil unit 3 by a 0.5 mm mold (the bottom plate 14*a* of the housing 14). The distance between the belt 6 and the coil 15 is constant at 1.5 mm (the distance between the mold surface and the belt surface is 1.0 mm), and the belt 6 is uniformly heated.

The coil unit 3 including the coil 15 is disposed outside, i.e., not inside, of the belt 6 where the temperature becomes high. Therefore, the temperature of the coil 15 is not easily increased, and the electrical resistance does not rise. For this reason, it is possible to reduce the loss due to Joule heating even if a high frequency current is applied. Moreover, providing the coil 15 outside contributes to the reduction of the diameter of the belt 6 (low heat capacity). Therefore, it can be said that this arrangement is excellent also in energy saving.

Regarding the warming-up time of the fixing device F of this embodiment, the heat capacity is very low. Therefore, if 1200 W is supplied to the coil 15, for example, it can reach 180 degrees, which is the target temperature, in about 15 seconds, so a heating operation during stand-by state is unnecessary. For this reason, power consumption can be kept very low.

In a state in which the roller 2 is driven and the temperature of the belt 6 rises to a predetermined fixing temperature and is adjusted as described above, the sheet P carrying the unfixed toner image is guided by the guide member 24 and is introduced into the nip portion N with the toner image carrying surface side facing the belt 6. The sheet P is in close contact with the outer peripheral surface of the belt 6 at the nip portion N and is nipped and fed together with the belt 6 at the nip portion N.

As a result, receiving mainly the heat of the belt 6 and receiving the pressure of the nip N, the unfixed toner image is heat-pressure fixed on the surface of the paper P. The paper P having passed through the nip portion N is self-separated (curvature separation) from the outer peripheral surface of the belt 6 and fed to the outside of the fixing device, using the deformation of the surface of the belt 6 at the exit of the nip N. In this embodiment, the introduction of the sheet P into the fixing device F is performed in a so-called center reference feeding fashion at the center of the sheet width. In part (a) of FIG. 4, 0 is a central reference line (imaginary line).

(2-6) Pressure Change Operation

The cams 22L and 22R have a two-peak shape, as shown in FIG. 9. With reference to FIG. 10, the position of the belt 6 when the cams 22L and 22R rotate will be described Part (a) of FIG. 10 shows the state in the normal pressure mode. In this mode, the flat portions of the cams 22L and 22R are in the upward rotational angle attitude. The cams 22L and 22R are not in contact with the levers 18L and 18R. Therefore, the spring force of the springs 19*a* of the spring loaded screws 19L and 19R sufficiently act on the levers 18L and 18R, such that the pressure at the nip N is at the predetermined first pressure (normal pressure) (pressing structure).

In the case of the normal pressure mode (the first pressure mode) in this embodiment, the force (total pressure of the nip) applied to the heating assembly (belt unit) 1 is 500 N. The normal pressure may be 100 N to 900 N.

In the normal pressure mode shown in part (a) of FIG. 10, the cams 22L and 22R rotate in the clockwise direction to rotate the levers 18L and 18R against the spring force of the spring 19*a* of the spring-loaded screw 19R until the first peak (peak 1) position (part (a) to part (b)). Then, the pressure to the flange members 10L and 10R is halved, and the position of the belt 6 rises up by ΔY1 (part (a) to part (b)). By this arrangement, the envelope pressure mode (second pressure mode) in which the pressure in the nip N is lower (weaker, lighter pressure) than the first pressure in the normal pressure mode (pressure reduction structure) is established.

In this embodiment, in the case of this envelope pressure mode, the force (total pressure of the nip) applied to the heating assembly (belt unit) 40 is set to 30 N. As light pressure, 10 N to 90 N may be employed.

When the cams 22L and 22R are further rotated to push the levers 18L and 18R up to the position of the second (highest peak) (peak 2), the belt 6 further rises by ΔY2. Then, the pressure on the spring force of the spring 19*a* of the spring-loaded screw 19R against the flange members 10L and 10R is made ineffective, so that the belt 6 and the roller 2 are in the pressure release mode (pressure release state, or pressure release structure) (part (b) to part (c)).

When the image forming apparatus is in a stand-by state or a non-image forming state, the controlling portion (execution section) 57 sets the fixing device F in the pressure releasing mode of part (c) of FIG. 10. When the paper P to be passed through the fixing device F is a type other than the envelope, the fixing device F is set to the normal pressure mode of part (a) in FIG. 10. When the paper P is an envelope, the fixing device F is set to the envelope pressure mode (decreased pressure structure) of part (b) of FIG. 10.

(2-7) Pressing Mode

Referring to FIGS. 11 and 12, the pressurization forms at the nip portion N in the normal pressure mode and the envelope pressure mode of the fixing device F in this embodiment will be described. Part (a) of FIG. 11 and part (a) of FIG. 12 are cross-sectional views when paper (plain paper) P other than the envelope passes through the nip portion N in each mode. Part (b) of FIG. 11 and part (b) of FIG. 12 are cross-sectional views when the envelope passes through the nip portion N in each mode. Part (c) of FIG. 11 and part (c) of FIG. 12 show the velocity distribution applied to the envelope cover when passing envelopes in each mode.

In the normal pressure mode, as shown in part (a) of FIG. 11, the upstream side projecting portion 8*a*, the main pressure portion 8*b*, and the downstream side projecting portion 8*c* of the pressure pad 8, which is the pressure applying member, press against the belt 6. When paper P other than the envelope is passed, the paper discharged from the nip N is downward, since the upstream projecting portion 8*b* and the downstream projecting portion 8*c* of the pad 8 have the upward projection shape of the nip portion N. This ensures sufficient separability from the fixing belt 6, even when paper with a low basis weight and a low stiffness is passed.

On the other hand, as shown in part (b) of FIG. 11, when the envelope passes through the nip portion N in the normal pressure mode, the nip N has an upward projection shape, by the upstream and downstream projections 8*a* and 8*c* of the pressure pad 8, in the part of the envelope not constrained between the front and back sides. For this reason, due to the deformation of the envelope passing through the nip N, a difference in feeding amount occurs between the upper surface and the lower surface of the envelope.

Part (c) of FIG. 11 shows the feed amounts of the surface of the front side when the envelope is the long type no. 3 (solid arrow) and the feed amount of the back surface (dotted arrow). In the envelope, the front and back sides of at least one side in the width direction of the belt 6 are restrained with each other. In the case of long type no. 3, the position indicated by x is the restraint point. The restrained portion will be continuous between the front and back sides. Therefore, the restrained portion passes through the nip portion N at an intermediate conveyance amount between the conveyance amounts of the front and back sides. Because of this difference in feed amount in the belt width direction between the restricted portion and the unconstrained portion of the envelope, a rotational moment indicated by a hollow arrow occurs. An envelope crease w occurs when the stiffness of the paper P becomes unable to tolerate the accumulated of stress by this arrangement.

In this embodiment, the purpose is to make the nip portion N convex-up in the normal pressure mode. Therefore, it is not necessary for the belt 6 to be in contact with all of the main pressure portion 8*b* of the pressure pad 8, and it suffices if a part of the main pressure portion 8*b* is in contact with the belt 6.

In the envelope pressure mode, as shown in part (a) of FIG. 12, both the upstream side projecting portion (projecting portion) 8*a* and the downstream side projecting portion (projecting portion) 8*c* of the pressure pad 8 are pressed against the belt 6. The main pressure portion (base portion) 8*b* is separated from the belt 6. More specifically, the main pressure portion 8*b* is almost entirely separated from the inner surface of the belt 6, including the central part in the recording material feeding direction. When paper P other than the envelope is passed through, the nip portion N does not have the convex-up shape and is in a substantially straight shape due to the stiffness of the upstream and downstream projecting portions 8*a* and 8*c* of the pressure pad 8 and the belt 6. The paper out of the nip N is discharged straight. In this case, there is no problem with paper P that has a two layer structure, like envelopes, and that has high stiffness. When plain paper P, including a small basis weight and a low stiffness is passed through the nip portion N, however, the curvature of the belt 6 cannot sufficiently assure the separability in some cases.

On the other hand, as shown in part (b) of FIG. 12, when the envelope passes through the nip portion N in the envelope pressure mode, the nip portion N is not in the convex-up shape, but is in a straight shape, in a portion not restricted by the front and back sides of the envelope. Therefore, it is possible to suppress the deformation of the envelope passing through the nip portion N and to suppress the difference between the feed amounts of the front and back sides of the envelope (part (c) in FIG. 12). As a result, it is possible to suppress the difference in speed in the belt width direction between the restrained portion and the unrestrained portion of the envelope, so that production of an envelope crease can be prevented.

In this embodiment, in the envelope pressure mode, as shown in part (b) of FIG. 12, the belt 6 is supported only by the upstream side projecting portion 8*a* and the downstream side projecting portion 8*c* of the pressure pad 8. Therefore, the main pressure portion 8*b* does not contact the belt 6. In the envelope pressure mode, there may be an exceptional case a portion of the main pressure portion 8*b* contacts the belt 6 unexpectedly. For example, this occurs when the upstream and downstream projections 8*a* and 8*c* are not sufficiently high in the mechanical tolerance range, or when the upstream and downstream projections 8*a* and 8*c* are lowered due to wear. Also, when envelopes with high stiffness pass through the nip portion N in the envelope pressure mode, the belt 6 may be deformed and a portion of the belt 6 may be instantaneously brought into contact with the main pressure portion 8*b* of the pressure pad 8. Because an envelope is less vulnerable to crease, however, there is no problem arising in which the main pressure portion 8*b* contacts the belt 6. Examples of highly rigid envelopes include, for example, an envelope of a long type no. 3, corner bonded, AR, ultra white 130, no zip code frame, 120 mm×235 mm, basis weight of 130 g/m$^2$, manufactured by Yamazakura Kabushiki Kaisha, of Japan.

(2-8) Control

Referring to FIG. 13 showing a block diagram of the control system, the control of this embodiment will be described. The control portion (execution portion) 57 exchanges various types of electrical information with the operating portion (selection portion) C and external devices (PC, print server, and so on) D, and controls an overall printing operation (image forming operation) of the printer portion B. Operation portion C is a user interface for performing print mode setting by the user (operator, user), various instructions of printing conditions, such as sheets to use, the number of sheets, input of settings, and status notification of the device to the operator.

The recording material type (recording material information, such as paper size, basis weight, paper type, and the like), input by the user, is fed to the recording material information processing portion 102, using the operating portion C and the external device D as input portions. Information of the recording material information processing portion 102 is transferred into a central processing unit (CPU) 100 of the printer control portion 57. The CPU 100 looks up a memory 101 and instructs the pressure control portion 104 to set the pressure of the fixing device F to a predetermined value according to the information of the recording material information processing portion 102.

In other words, the CPU 100 of the printer control portion 57 controls the change mechanism based on the recording material information acquired on the recording material to be used, to switch between the first pressurization mode and the second pressurization mode.

The pressure control portion 104 controls the pressure of the fixing device F to a predetermined pressure. In other words, when the paper to be used is plain paper (setting information of the recording material other than the envelope), as described above, the pressure of the fixing device F becomes the normal pressure (the first pressure mode) and controls the motor M2 to operate the changing mechanism. If the envelope (envelope setting information) is selected, the motor M2 is controlled so as to be in the envelope pressure (second pressure mode), and the change mechanism is operated.

Further, the CPU 100 can control the belt 6 at a predetermined temperature by controlling the power supply device 103 for supplying power to the coil 15, in response to the information of the temperature and humidity sensor E (FIG. 2) mounted to the image forming apparatus main assembly and the temperature detected by the temperature sensor TH for the belt 6. The CPU 100 can control the motor M1 for driving the pressure roller 2 to rotate or to stop the pressure roller 2.

With reference to the flowchart shown in FIG. 1, the control of this embodiment will be described. First, the image forming apparatus accepts an image forming job (JOB). After that, the CPU 100 discriminates whether or not the paper to be passed is an envelope (envelope job) (S1000). If the sheet to be passed is not an envelope, the CPU 100 sets the pressure of the fixing device F to the pressure of the normal pressure mode (S1001), and performs the image forming operation and the fixing operation (S1003). In S1000, if the paper to be passed is an envelope, the CPU 100 sets the pressure to the envelope pressure mode (S1002), and the image forming operation and the fixing operation (S1003) are performed.

With reference to the flowchart of FIG. 14, the fixing operation in the normal pressure mode and the envelope pressure mode will be described. First, the CPU 100 drives the pressure roller contacting/spacing motor M2 to adjust the pressure of the fixing device F to the normal pressure (S1100). Next, the CPU 100 drives the pressure roller 2 by the drive motor M, rotationally drives the pressure roller 2 and the belt 6, and applies a voltage to the coil 15 to heat the belt 6 (S1101). The heating and the rotation are continued until the belt 6 reaches the predetermined control temperature (S1102).

Figure 1:
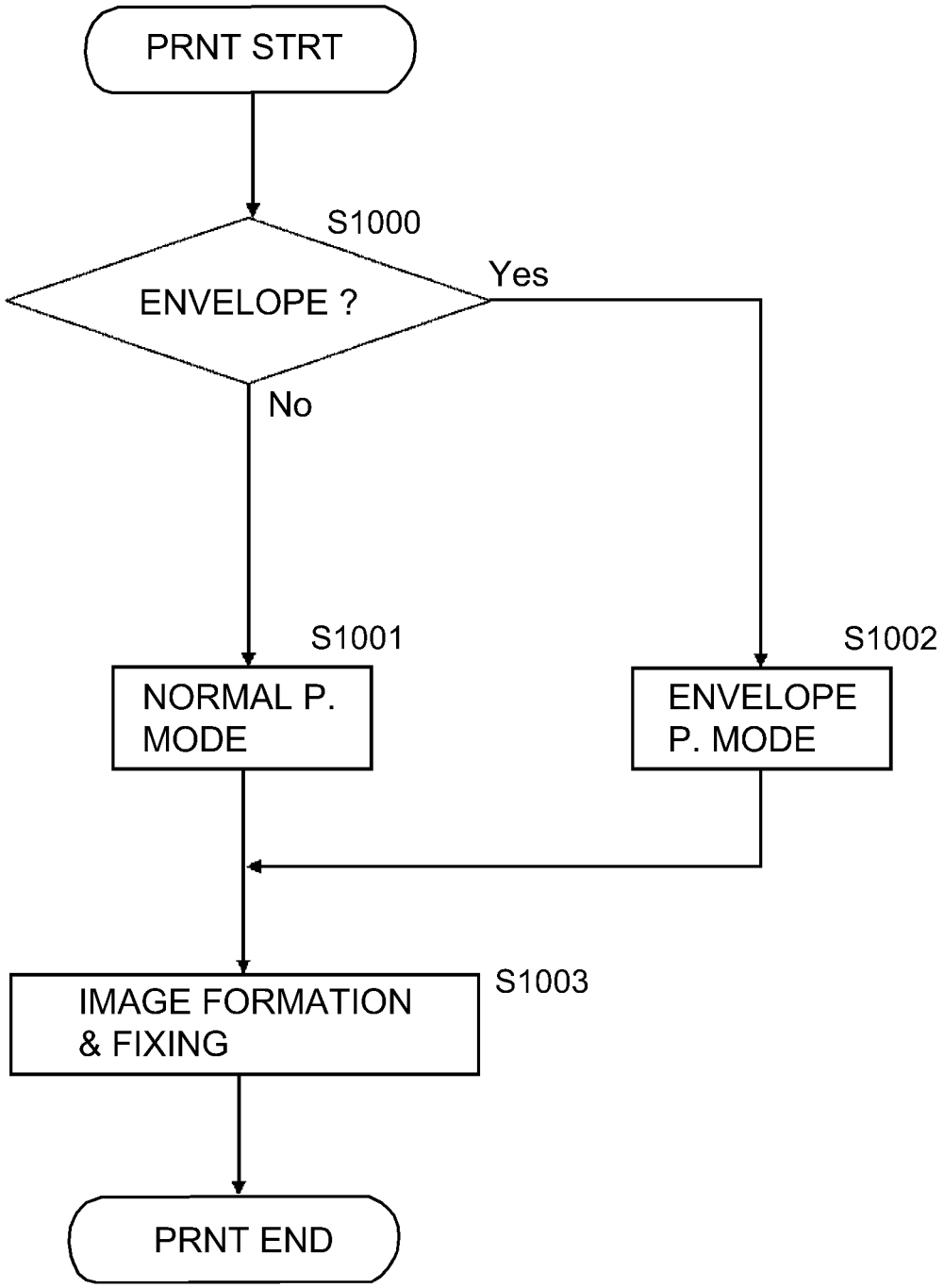
FIG. 1 is a control flowchart of an image forming apparatus according to Embodiment 1.

If the mode determined in the flow of FIG. 1 is the envelope pressure mode, the pressure of the fixing device F is switched to the envelope pressure (S1103, S1104). The CPU 100 introduces the sheet P carrying the unfixed toner image into the nip portion N by the image forming operation of the image forming portion, and fixes the unfixed toner image on the sheet P (S1105).

The CPU 100 performs the operations from S1103 to S1105 until the print job is completed (S1106). When the print job is completed, the rotation of the drive motor M and the power supply to the coil 15 are stopped (S1107). In accordance with the settings after the end of the print job, the pressure roller dismounting motor M2 is driven to change the pressure of the fixing device F to normal pressure or pressure release (S1108).

Table 1 shows the results of experiments of this embodiment. In the experiment, under the environment of 30 degrees temperature and 80% humidity, 10 sheets of the long type no. 3 envelope (long type no. 3, medium pasted, real Kent CoC 80, no zip code frame, 120 mm×235 mm, basis weight 80 g/m$^2$, manufactured by Yamazakura Kabushiki Kaisha, of Japan) are continuously pass through.

An envelope crease is produced in an envelope during the normal pressure mode, but thin paper plain paper is problem free. In the envelope pressure mode, an envelope crease did not occur, but paper winding on the fixing belt 6 occurred due to poor separation of thin plain paper. The normal pressure mode and the envelope pressure mode are the result of adjusting the upstream side projecting portion 8*a* and the downstream side projecting portion 8*c* of the pressure of the pressure pad 8, which is the pressure applying member. In other words, it is understood that, in the envelope pressure mode, a straight nip is formed to prevent an envelope crease, and, in the normal pressure mode the separability of thin paper can be secured without problems by the convex-up shape of the nip portion N.

As described above, in the case of the envelope, the envelope pressure mode, in which the upstream and downstream projections 8*a* and 8*c* of the pressure pad 8 form the straight nip supporting the fixing belt 6, is used. In this way, in the normal pressure mode, the convex-up nip is formed by the pressurization by the upstream and downstream projections 8*a* and 8*c* and the main pressure part 8*b* of the pressure pad 8, so that it is possible to provide a fixing device F that is capable of crease prevention for the envelope and with assured separability for the plain paper.

TABLE 1

| | Normal Pressure Mode | Envelope Pressure Mode |
|---|---|---|
| Envelope (Basis weight of 80 g/m$^2$) | Crease: X | ○ |
| Plain Paper (Basis weight of 52 g/m$^2$) | ○ | Separation: X |

Second Embodiment

In Embodiment 2, the structure of Embodiment 1 is used, but the flowchart of FIG. 15 is used instead of the flowchart of FIG. 1. The stiffness of the envelope is discriminated by at least one of environmental temperature, humidity, and basis weight of the envelope, and it is discriminated whether or not to perform the envelope pressure mode. The same reference numerals are given to the corresponding elements in Embodiment 1, and an explanation of those corresponding elements is omitted.

With reference to the flowchart shown in FIG. 15, the control of Embodiment 2 will be described. Operations similar to those in FIG. 1 are given the same numbers and an explanation of those operations is omitted. In the constitution of Embodiment 2, when the paper to be fed is the envelope in S1000, and it is discriminated that the envelope stiffness is greater than the predetermined value, the normal pressure mode is set. When the stiffness of the envelope is discriminated as being less than the predetermined value, the envelope pressure mode is set, and fixing operation is performed (S2000).

That is, the CPU 100, as the control means, includes a discriminating portion for discriminating the stiffness of the recording material to be used. In a case in which the recording material information is an envelope, the CPU 100 executes the first pressure mode when the stiffness of the envelope is discriminated as being greater than a predetermined value by the discriminating portion.

The stiffness of the envelope is discriminated by the CPU 100 based on the basis weight information of the envelope set by the user at the input portion of the external device D, such as a personal computer (PC) or the operating portion C, and based on the temperature and humidity information by the environmental sensor E. In Embodiment 2, the CPU 100 of the printer control portion 57 discriminates the absolute moisture content in the air based on the temperature and humidity information detected by the temperature and humidity sensor E.

In Embodiment 2, when the weight of water per 1 kg of air is 8 g or more, an envelope having a basis weight greater than 100 g/m$^2$ is discriminated to have high stiffness, and the normal pressure mode is selected. When the basis weight is 100 g/m$^2$ or less, the envelope pressure mode is selected. The fixing operation is performed based on the selection. If the weight of water per 1 kg of air is less than 8 g, an envelope having a basis weight greater than 80 g/m$^2$ is discriminated to have high stiffness, and the normal pressure mode is selected. In the case of a basis weight of 80 g/m$^2$ or less, the envelope pressure mode is selected. The fixing operation is performed based on the selection.

Tables 2 and 3 show the results of experiments of the second embodiment. In the experiments, the results when ten sheets were continuously fed using the following envelopes of types (1) to (3), under the environment of 30 degrees, 80% humidity (Table 2), and under the environment of 15 degrees, 10% humidity (Table 3). If an envelope crease is not produced with all ten sheets, "0" is marked, and if even one of the sheets produces the crease, X is marked.

(1) Long type no. 3 envelope (long type no. 3, middle pasted Real Kent CoC 80, no zip code frame, 120 mm×235 mm, basis weight 80 g/m$^2$, manufactured by Yamazakura Kabushiki Kaisha, of Japan)

(2) Envelope (long type no. 3, middle pasted Real Kent CoC 100, no zip code frame, 120 mm×235 mm, basis weight 100 g/m$^2$, manufactured by Yamazakura Kabushiki Kaisha, of Japan)

(3) Envelopes (long type no. 3, corner pasted, AR, ultra white, no zip code frame, 120 mm×235 mm, basis weight 130 g/m$^2$ manufactured by Yamazakura Kabushiki Kaisha, of Japan)

An envelope crease is produced in envelopes having a basis weight of 80 g/m$^2$ and in envelopes having a basis weight of 100 g/m$^2$ in the normal pressure mode because of the low stiffness of the envelope (Table 2) in the case of high temperature and high humidity, such as an environment having a temperature of 3 degrees and a humidity of 80%, but in the envelope pressure mode, an envelope crease is not produced and a satisfactory image can be obtained. In thick envelopes with a basis weight of 130 g/m$^2$, the crease does not appear due to the stiffness of the envelope, but in the envelope pressure mode, a sufficient nip width cannot be secured, and, therefore, the heat is insufficient and an improper fixing occurred.

In the case of a low temperature and low humidity environment, such as an environment having a temperature of 15 degrees and a humidity of 10% (Table 3), the envelopes have a high stiffness, and, unlike the case of Table 2, the envelope crease is not produced in the case of the envelope having the basis weight of 100 g/m$^2$ a normal pressure mode. Because the nip width cannot be secured sufficiently in the envelope pressure mode, however, the amount of heat was insufficient and a slight peeling (fixing defect) occurred.

As described above, in Embodiment 2, the stiffness of the envelope is discriminated on the basis of at least one of environmental temperature, humidity, and basis weight of envelope, and it is discriminated whether or not the normal pressure mode is to be selected. By selecting the optimum mode for the basis weight of envelopes used, it is possible to prevent the production of an envelope crease and to prevent the occurrence of poor fixing due to insufficient supply of heat to the paper.

TABLE 2

| 30 degs. & 80% condition | Normal Pressure Mode | Envelope Pressure Mode |
|---|---|---|
| Envelope (Basis weight of 80 g/m$^2$) | Crease: X | ○ |
| Envelope (Basis weight of 100 g/m$^2$) | Crease: slight | ○ |
| Envelope (Basis weight of 130 g/m$^2$) | ○ | Crease: ○<br>Fixing property: X |

TABLE 3

| 15 degs. & 10% condition | Normal Pressure Mode | Envelope Pressure Mode |
|---|---|---|
| Envelope (Basis weight of 80 g/m$^2$) | Crease: slight | ○ |
| Envelope (Basis weight of 100 g/m$^2$) | ○ | Crease: ○<br>Fixing property: Δ |
| Envelope (Basis weight of 130 g/m$^2$) | ○ | Crease: ○<br>Fixing property: X |

Third Embodiment

Embodiment 3 uses the structure of Embodiment 1 and uses a flowchart of FIG. 16 instead of the flowchart of FIG. 1. In the case of normal pressure, preheating rotation of the apparatus is performed for a predetermined time. With this structure, a slip does not occur even after a durability test or when using high viscosity grease. In regards to the structure that is the same structure as in Embodiment 1, the same numbers are assigned and an explanation will be omitted.

The control of Embodiment 3 will be described with reference to the flowchart shown in FIG. 16. Operations similar to those in FIG. 14 are given the same reference numerals, and a description of those operations is omitted. In the structure of Embodiment 3, when the envelope pressure mode is selected in S1103, the apparatus is heated (rotated in the preheating) for a predetermined time while maintaining the controlled temperature (S3000).

Table 4 shows the results of experiments of the third embodiment. With the structure of Embodiment 1, 600 thousands of sheets CS680 (A4 size manufactured by Canon, and having a basis weight of 68 g/m$^2$) were passed through transversely. Then, the heating belt rotation time in the operation of S3000 in FIG. 16 was changed, and the pressure was changed to the envelope pressure. The case in which the fixing belt 6 was rotationally driven by the pressure roller 2, driven by the driving motor M1, was indicated as "O".

It is understood that, if the heating idle rotation time is less than 5 seconds in the operation of S3000, the fixing belt 6 slips. This is because the grease in the fixing nip portion N mixes with worn powder and deteriorates due to the durability and the viscosity increasing. In the case of the envelope pressure mode, the fixing nip portion N becomes narrow, and, therefore, the transmission of the driving force from the pressure roller 2 is weak.

Therefore, in the structure of Embodiment 3, heat idle rotation is performed in a state in which sufficient driving force is transmitted to the fixing belt 6 at normal pressure, and the deteriorated grease in the neighborhood of the fixing nip portion N is sufficiently warmed to lower the viscosity thereof. By this arrangement, slipping of the fixing belt 6 can be avoided. In other words, when executing the second pressure mode, it is preferable that, after the apparatus is preheated and rotated for a predetermined time in the first pressure mode, the second pressure mode is started.

In Embodiment 3, the heating idle rotation time is always constant, but heating and idle rotation may be carried out only when necessary, in consideration of the accumulated number counted by the counter and the viscosity of the grease obtained from the belt temperature history of the temperature sensor TH.

TABLE 4

| | Heating Idle rotation (s) | | | |
|---|---|---|---|---|
| | 0 | 5 | 10 | 15 |
| Belt Slippage | X | X | ○ | ○ |

Fourth Embodiment

Next, Embodiment 4 will be described. The description of the structure that is the same structure of Embodiment 1 will be omitted.

With reference to the block diagram of the control system shown in FIG. 13, the control in this embodiment will be described. The control portion 57 exchanges various kinds of electrical information with the operating portion C and external devices (PC, print server, etc.) D, and controls the overall printing operation (image forming operation) of the printer portion B. The operating portion C is a user interface for setting the print mode of the user (operator, user), instructing printing conditions, such as the kind of the used sheets and the number of sheets, inputting settings, and notifying the status of the device to the operator.

Information (recording material setting information, such as paper size, basis weight, paper type, and the like) of the recording material type, input by the user on the operating portion C and the external device D, is fed to the recording material information processing portion 102. Information of the recording material information processing portion 102 is transferred into the CPU 100 of the printer control portion 57. The CPU 100 looks up the memory 101 and instructs the pressure control portion 104 to set the pressure of the fixing device F to a predetermined value based on the information of the recording material information processing portion 102.

The pressure control portion 104 controls the pressure of the fixing device F to a predetermined pressure. In other words, when the paper to be used is plain paper (setting information of a recording material other than the envelope), the pressure control portion 104 controls the motor M2 to operate the changing mechanism so that the pressure in the fixing device F becomes the normal pressure (the first pressure mode). When the paper to be used is an envelope (setting information of the envelope), the motor M2 is controlled so that the pressure of the fixing device F becomes the envelope pressure (the second pressure mode).

Also, the CPU 100 can control the belt 6 to a predetermined temperature by controlling the power supply device 103 for feeding the coil 15 with the electrical power, based on the information of the temperature and humidity sensor E (FIG. 2) mounted to the image forming apparatus main assembly and the temperature detected by the temperature sensor TH of the belt 6. The CPU 100 controls the motor M1 for driving the pressure roller 2 to rotate or to stop the pressure roller 2.

As shown in part (a) of FIG. 20, the operating portion C functioning as a selection portion has a touch panel 403 (manual input means by which the user can input various information) as an operation panel 41 provided with a plurality of keys on which a key operation for instructing by the user is performed, and a display portion including a liquid crystal display, or the like. The operation panel 41 is provided with a start button (button for instructing the start of image formation) 401, a numerical value input button (buttons of respective numbers from 0 to 9) 402, and a sub power switch 404 as a hard key (the part the user performs key operation).

Instruction buttons related to image formation are displayed on the touch panel 403 as soft keys (a part at which the user performs a key operation). The instruction buttons include buttons for setting the type of recording material (setting the basis weight of the paper), buttons for instructing image formation on both sides of the recording material, buttons for instructing the staple processing, etc. Various instructions are made by the user touching these buttons (keys).

The touch screen 403 of the liquid crystal display portion of the operation panel 41 and the display screen displayed on the display of the PC (personal computer) as the external device D have a common interface. Therefore, the display screen of both of the touch screen 403 and the display screen of the external device D will be described with the same reference numeral 403.

When the user prints or copies, the paper type is selected on the display screen 403 shown in part (b) of FIG. 20. In this case, if the envelope key B101 is selected, the display screen 403 is switched to the screen shown in part (c) of FIG. 20. Then, the user can select between the key B201 giving priority to an envelope crease reduction or the key B202 giving priority to image quality. The information designated by the user through the operating portion C or the external device D in this manner is transmitted to the CPU 100 through the recording material information processing portion 102.

With reference to the flowchart shown in FIG. 19, the control of this embodiment will be described. First, the image forming apparatus accepts an image forming job (JOB). The CPU 100 determines whether the job is an envelope job in which the envelope key B101 is set by the user on the display screen 403 (S1000'). If the sheet P to be passed is not an envelope, the CPU 100 sets the pressure of the fixing device F to the normal pressure mode (S1002'), and performs the image forming operation and the fixing operation (S1004).

When it is an envelope job for which the envelope key B101 is set on the display screen 403, the CPU 100 next determines in step S1000' whether the user has selected the crease improvement mode in which the envelope crease reduction key B201 is set (S1001'). If the user selects the crease improvement mode, the pressure of the fixing device F is set to the envelope pressure mode (S1003'), and the image forming operation and the fixing operation are performed (S1004') accordingly.

When the user presses the image quality priority key B202 to select the image quality priority mode, the pressure of the fixing device F is set to the normal pressure mode (S1002'), and the image forming operation and the fixing operation are performed (S1004') accordingly. That is, even when the envelope setting information is input, the CPU 100 executes switching to the normal pressure mode (the first pressure mode) on the basis of other image formation setting information.

With reference to the flowchart shown in FIG. 14, the fixing operation in the normal pressure mode and the envelope pressure mode will be described. First, the CPU 100 drives the pressure roller contacting/spacing motor M2 to adjust the pressure of the fixing device F to the normal pressure (S1100). Next, the CPU 100 rotates the pressure roller 2 and the belt 6 by driving the pressing roller 2 using the driving motor M, and applies a voltage to the coil 15 to heat the belt 6 (S1101). The heating and the rotation are continued until the temperature of the belt 6 reaches the predetermined temperature (i.e., the control temperature) (S1102).

If the mode determined in the flow of FIG. 19 is the envelope mode, the pressure of the fixing device F is switched to the envelope pressure (S1103, S1104). The CPU 100 introduces the sheet P, carrying the unfixed toner image formed by the image forming operation of the image forming portion, into the nip portion N and fixes the unfixed toner image on the sheet P (S1105).

Then, the CPU 100 performs the operations from S1103 to S1105 until the print job is completed (S1106). When the print job is completed, the rotation of the drive motor M and the power supply to the coil 15 are stopped (S1107). Based on the setting for the operation to be made after finishing the print job, the CPU 100 drives the pressure roller contacting/spacing motor M2 to change the pressure of the fixing device F to the normal pressure mode or the pressure release mode (S1108).

Table 5 shows the results of experiments of this embodiment. In the experiments, in an environment having a temperature of 30 degrees and a humidity of 80%, in each of the image quality priority mode and the crease reduction mode, ten Kent envelopes (i.e., type (1) envelopes) and ten laser printer envelopes (i.e., type (2) envelopes) carrying whole surface blue images were continuously fed.

(1) Kent Envelope long type no. 3 (long type no. 3, middle pasted, real Kent CoC 100, no zip code frame, 120 mm×235 mm, basis weight of 100 g/m$^2$, manufactured by Yamazakura Kabushiki Kaisha, of Japan)

(2) Long type 3 envelope for laser printer (long type no. 3, corner pasted, POD white 2.0, 100 g/m$^2$, no frame, 120 mm×235 mm, basis weight of 100 g/m$^2$, manufactured by Yamazakura Kabushiki Kaisha, of Japan). Here, if the envelope crease is not produced in all ten envelopes, "O" is marked, and, if a crease appeared even in one envelope, X is marked. In the image quality priority mode, envelope creases are generated in the Kent envelopes, but the envelopes for laser printers are problem free. This is because the envelopes for laser printers are treated with air holes, and, therefore, the generation of an envelope crease is suppressed. In the envelope pressure mode, the envelope crease is not produced in either envelope, but, in both envelopes, there is unevenness in the background of the paper (pattern) and a pattern (step unevenness) in the neighborhood of the portion in which the envelope is pasted. This is because the surface layer of the fixing belt 6 cannot sufficiently follow the surface of the paper of the envelope because the pressure is small with the envelope pressure of this embodiment.

As is clear from this experiment, even in the case of fixing an envelope with less risk of crease on the envelope, such as an envelope for a laser printer, there is a liability of unnecessarily lowering the image quality by a fixing operation with the envelope pressure. Therefore, such a problem can be avoided by the structure with which the user can freely select whether priority is given to an envelope crease reduction or image quality, as in the invention of this embodiment.

TABLE 5

| | Image quality priority mode | Crease reduction priority mode |
|---|---|---|
| Kent Envelope | Crease: X/Image quality: ○ | Crease: ○/Image quality: Δ |

TABLE 5-continued

| | Image quality priority mode | Crease reduction priority mode |
|---|---|---|
| Envelope for laser printer | Crease: ○/Image quality: ○ | Crease: ○/Image quality: Δ |

Fifth Embodiment

In this embodiment, the structure of the fixing device of Embodiment 4 is modified so that it is possible to register whether priority is given to the envelope crease reduction or the image quality for each sheet feed cassette.

That is, the image forming apparatus has sheet feeding cassettes, as a plurality of recording material accommodating portions. By controlling the change mechanism based on the paper information (recording material setting information) on the sheet feed cassette selected by the user from among the plurality of sheet feed cassettes on the operation portion C, the CPU 100 executes switching between the normal pressure mode (the first pressure mode) and the envelope pressure mode (the second pressure mode).

Specifically, the envelope, serving as the sheet P accommodated in the upper sheet feeding cassette 69 in FIG. 2, is the Kent envelope (i.e., type (1) in Embodiment 4), and the sheet P accommodated in the lower sheet feeding cassette 70 is an envelope for a laser printer (i.e., type (2) in Embodiment 4). In this case, it is possible to set the upper sheet feed cassette 69 to the crease reduction mode and the lower sheet feed cassette 70 to the image quality priority mode. This enables the user to print the envelope in the optimum mode without being conscious of the mode at the time of printing.

As described above, when the fixing device of this embodiment is used, it is possible to prevent production of an envelope crease in a low heat capacity type fixing device and to adjust the occurrence of the envelope crease and a lowering of image quality according to user's preference.

Sixth Embodiment

In sixth embodiment, the structure of the first to fifth embodiments is modified so that the coil unit (induction heater) 3 for heating the belt 6 is omitted, and, instead, the belt 6 is heated by a halogen heater 15'. In regards to the structure that is the same structure as in Embodiment 1, the same reference numerals are given and an explanation thereof will be omitted.

As shown in FIG. 17, the halogen heater 15' is provided inside the stay 7', and heats the belt 6 by radiant heat therefrom. The stay 7' comprises a heat-resistant glass that transmits the light of the halogen heater 15'. As in Embodiment 1, the halogen heater 15' is connected to the power supply device 103 controlled by the CPU 100 of the control portion 57. The halogen heater 15' is ON/OFF controlled by the CPU 100 based on the temperature information of the temperature sensor TH, so that the temperature of the fixing belt 6 becomes a predetermined temperature.

With the above structure, even when the halogen heater 15' is usable instead of the coil 15, the same effects as those of the first to fifth embodiments can be provided.

Seventh Embodiment

In Embodiment 7, the structure of the fixing device of the first to fifth embodiments is modified so that the coil unit (induction heating device) 3 for heating the belt 6 is omitted, and the belt 6' has a resistance heating layer. For the structure that is the same structure as in Embodiment 1, the same reference numerals are given and an explanation thereof is omitted.

Part (a) of FIG. 18 shows the structure of the fixing device of this embodiment. The part related to induction heating is omitted from the fixing apparatus structure of the first embodiment, and the belt 6 is changed to the belt 6' including the resistance heating layer.

With reference to part (b) of FIG. 18, the structure of the belt 6' including the resistance heating layer in this embodiment will be described. The belt 6' in this embodiment has five layers, including a slipping layer 6*d*, a base layer 6*a*', a heat generating layer 6*e*, an elastic layer 6*b*, and a releasing layer 6*c*, in that order, from the inner circumference side to the outer circumference side. Further, at the end portion in the belt width direction, a feeding electrode portion (not shown) is provided.

The belt 6' includes the base layer 6*a*' made of polyimide having an inner diameter of 4 mm. The thickness of this base layer 6*a*' is 60 μm. Although the insulating polyimide is usable with Embodiment 5, a resin belt, such as a belt formed of polyimide amide, polyetheretherketone (PEEK), PTFE, PFA, fluorinated ethylene propylene (FEP), or the like, and a metal belt, such as a belt formed of stainless steel (SUS), nickel or the like can be used as the base layer 6*a*'. When a conductive material is used as the base layer 6*a*', it is necessary to provide an insulating layer, such as an insulating later forming of polyimide, between the base layer 6*a*' and the heat generating layer 6*e*.

In order to reduce the sliding friction between the inner surface of the belt 6' and the temperature sensor TH, a 10 μm to 50 μm thick resin layer (slipping layer) 6*d*, such as a layer formed of fluororesin or polyimide, may be provided on the inner surface side of the base layer 6*a*'. In this example, a fluorine resin layer of 10 μm is provided.

The heat generating layer 6*e* is formed between the base layer 6*a*' and the elastic layer 6*b*. The heat generating layer 6*e* is a resistance heating element, in which a polyimide resin containing carbon, as conductive particles, is coated on the base layer 6*a*' with a uniform thickness. The total resistance of the heating layer 6*e* is 10.0Ω. Therefore, the electrical power generated when energizing the AC power supply with the voltage of 100V is 1000 W. Incidentally, this resistance value may be appropriately determined depending on the amount of heat generation required for the fixing device, and can be appropriately adjusted by the mixing ratio of carbon.

Further, a power supply electrode portion (not shown) is provided at both end portions of the belt 6', and a power supply electrode portion (not shown) is electrically connected to both ends of the heat generation layer 6*e*. The feeding electrode portion contains a material having conductivity characteristics, including silver and palladium.

As in Embodiment 1, the power supply electrode portion of the belt 6' is connected to the power supply device 103 controlled by the CPU 100 of the control portion 57, and is ON/OFF-controlled by the CPU 100 on the basis of the temperature information of the temperature sensor TH.

With the above-described structure, even when the belt 6' including the resistance heating layer is usable instead of the coil 15, the same effects as those of the first to fifth embodiments can be provided.

As described above, when the fixing device of this embodiment is used, it is possible to prevent production of an envelope crease in a low heat capacity type fixing device and to adjust the occurrence of an envelope crease and lowered image quality according to user's preference.

Other Embodiments (1) In the fixing device F of Embodiment, the pressure pad 8 is pressed against the pressure roller 2 by way of the belt 6, but the pressure roller 2 may be pressed by way of the belt 6 by employing a mechanism or a structure in which the pressure pad 8 is pressed. It is also possible to employ a mechanism or a structure in which the pressure pad 8 and the pressure roller 2 are mutually pressed by way of the belt 6. In other words, it is possible to employ a mechanism or a structure in which the pressure pad 8 and the pressure roller 2 are relatively pressed by way of the belt 6.

(2) The fixing device F, as a fixing portion, is not limited to the use as an apparatus for heating and fixing an unfixed toner image formed on a recording material into a fixed image. It is also effective as a device for adjusting the surface texture of an image, such as a device for improving the glossiness of an image by heating and pressing a toner image temporarily fixed on a recording material (such a device is also referred to as fixing device).

(3) The image forming apparatus is not limited to the image forming apparatus that forms a full color image, as in Embodiment, but may be an image forming apparatus for forming a monochrome image. In addition, the image forming apparatus can be implemented in various applications, such as a copying machine, a facsimile machine, a multifunction machine having a plurality of these functions, by adding a necessary device, equipment, and casing structure.

INDUSTRIAL APPLICABILITY

According to the present invention, a fixing device and an image forming method suitable for forming an image on an envelope or the like are provided.

The invention claimed is:

1. A fixing device for an envelope, the fixing device comprising:

(A) an endless belt configured to heat a toner image, formed on an envelope, in a nip portion;

(B) a driving rotatable member configured (a) to form the nip portion in cooperation with the endless belt, and (ii) to rotationally drive the endless belt; and (C) a pad configured to press the endless belt at an inner surface toward the driving rotatable member, the pad including:

(a) a base portion;

(b) a first projecting portion projecting from the base portion toward the driving rotatable member at an upstream end in a feeding direction of the envelope;

(c) a second projecting portion projecting from the base portion toward the driving rotatable member at a downstream end in the feeding direction of the envelope; and (d) a recess portion, provided between the first projecting portion and the second projecting portion in the feeding direction of the envelope, wherein, when a fixing process is performed on the envelope, the inner surface of the endless belt is in contact with both of the first projecting portion and the second projecting portion, and is spaced from the recess portion.

2. The fixing device according to claim 1, wherein when the fixing process is performed on the envelope, the inner surface of the endless belt is spaced from a portion of the base portion of the pad, which is at a central portion of the pad in the feeding direction of the envelope.

3. The fixing device according to claim 1, further comprising (D) a heating portion configured to heat the endless belt.

4. An image forming apparatus comprising:

(A) an image forming portion configured to form a toner image on a recording material;

(B) an endless belt configured to heat the toner image, formed on the recording material, in a nip portion;

(C) a driving rotatable member configured (a) to form the nip portion in cooperation with the endless belt, and (b) to rotationally drive the endless belt;

(D) a pad configured to press the endless belt at an inner surface toward the driving rotatable member, the pad including:

(a) a base portion;

(b) a first projecting portion projecting from the base portion toward the driving rotatable member at an upstream end in a feeding direction of the recording material;

(c) a second projecting portion projecting from the base portion toward the driving rotatable member at a downstream end in the feeding direction of the recording material; and (d) a recess portion, provided between the first projecting portion and the second projecting portion in the feeding direction of the recording material; and (E) an executing portion configured to execute an operation in one of a plurality of modes, the plurality of modes including:

(a) a first mode, in which an inner surface of the endless belt is in contact with the first projecting portion, the second projecting portion, and the base portion provided between the first projecting portion and the second projecting portion with respect to the feeding direction of the recording material; and (b) a second mode, in which the inner surface of the endless belt is in contact with the first projecting portion and the second projecting portion, and is spaced from the recess portion.

5. The image forming apparatus according to claim 4, wherein, when a fixing process is performed on an envelope, as the recording material, the inner surface of the endless belt is spaced from a portion of the base portion of the pad, which is positioned at a center portion of the envelope with respect to the feeding direction.

6. The image forming apparatus according to claim 4, wherein the executing portion executes the operation in the first mode when a fixing process is performed on a predetermined recording material, the predetermined recording material excluding a predetermined envelope, as the recording material, and executes the operation in the second mode when the fixing process is performed on the predetermined envelope as the recording material.

7. The image forming apparatus according to claim 4, further comprising (F) a selecting portion configured to select one of the first mode and the second mode when a fixing process is performed on a predetermined envelope as the recording material.

8. The image forming apparatus according to claim 4, wherein the executing portion is capable of executing (c) a third mode, in which the pressure applied between the endless belt and the driving rotatable member is substantially released.

9. The image forming apparatus according to claim 4, further comprising (F) a heating portion for heating the endless belt.

* * * * *